US011471918B2

(12) United States Patent
Cardosa, II

(10) Patent No.: US 11,471,918 B2
(45) Date of Patent: Oct. 18, 2022

(54) DETACHABLY ATTACHABLE BUCKET IMPLEMENT COUPLER

(71) Applicant: John Cardosa, II, Phoenix, AZ (US)

(72) Inventor: John Cardosa, II, Phoenix, AZ (US)

( * ) Notice: Subject to any disclaimer, the term of this patent is extended or adjusted under 35 U.S.C. 154(b) by 0 days.

(21) Appl. No.: 17/719,337

(22) Filed: Apr. 12, 2022

(65) Prior Publication Data

US 2022/0258210 A1 Aug. 18, 2022

Related U.S. Application Data

(63) Continuation-in-part of application No. 17/216,275, filed on Mar. 29, 2021, which is a continuation-in-part of application No. 16/810,888, filed on Mar. 6, 2020, now Pat. No. 10,960,439.

(51) Int. Cl.
*B08B 1/00* (2006.01)

(52) U.S. Cl.
CPC ..... *B08B 1/005* (2013.01)

(58) Field of Classification Search
CPC ..... B08B 1/005; B44D 3/128; B44D 3/16; B44D 3/162; B44D 3/164
See application file for complete search history.

(56) References Cited

U.S. PATENT DOCUMENTS

| | | | | |
|---|---|---|---|---|
| 861,305 | A | * | 7/1907 | McFadden |
| 2,167,217 | A | | 7/1939 | Milligan |
| 2,536,215 | A | | 1/1951 | Povondra |
| 2,943,761 | A | | 7/1960 | Monier |
| 3,260,401 | A | | 7/1966 | Cortina |
| 3,899,107 | A | | 8/1975 | Gaal |
| 3,901,256 | A | | 8/1975 | Habostad |
| 4,101,046 | A | | 7/1978 | Puntillo |
| 4,867,332 | A | | 9/1989 | Mains |
| 5,033,704 | A | | 7/1991 | Kerr |
| 5,195,662 | A | | 3/1993 | Neff |
| 5,839,152 | A | | 11/1998 | Kruskamp |
| 6,705,480 | B1 | | 3/2004 | Saddler |
| 8,607,397 | B1 | | 12/2013 | Caver |

* cited by examiner

*Primary Examiner* — Stephen J Castellano
(74) *Attorney, Agent, or Firm* — Invention To Patent Services; Alex Hobson

(57) ABSTRACT

A bucket implement coupler is detachably attachable to a top rim of a bucket by an attachment flange that snaps down under a rim flange of the bucket when the bucket implement coupler is aligned over the top rim of the bucket and pressed down. The attachment flange may be configured proximal to the ends of the rim extension of the bucket implement coupler and an end slot may extend inward along the top of the rim extension to allow the interior and/or exterior flange of the rim extension to expand the rim slot and allow the attachment flange to slide down over the rim flange. The attachment flange extends inward into the rim slot from the exterior flange. Any number and type of implement may be attached to the bucket via the bucket implement coupler.

20 Claims, 24 Drawing Sheets

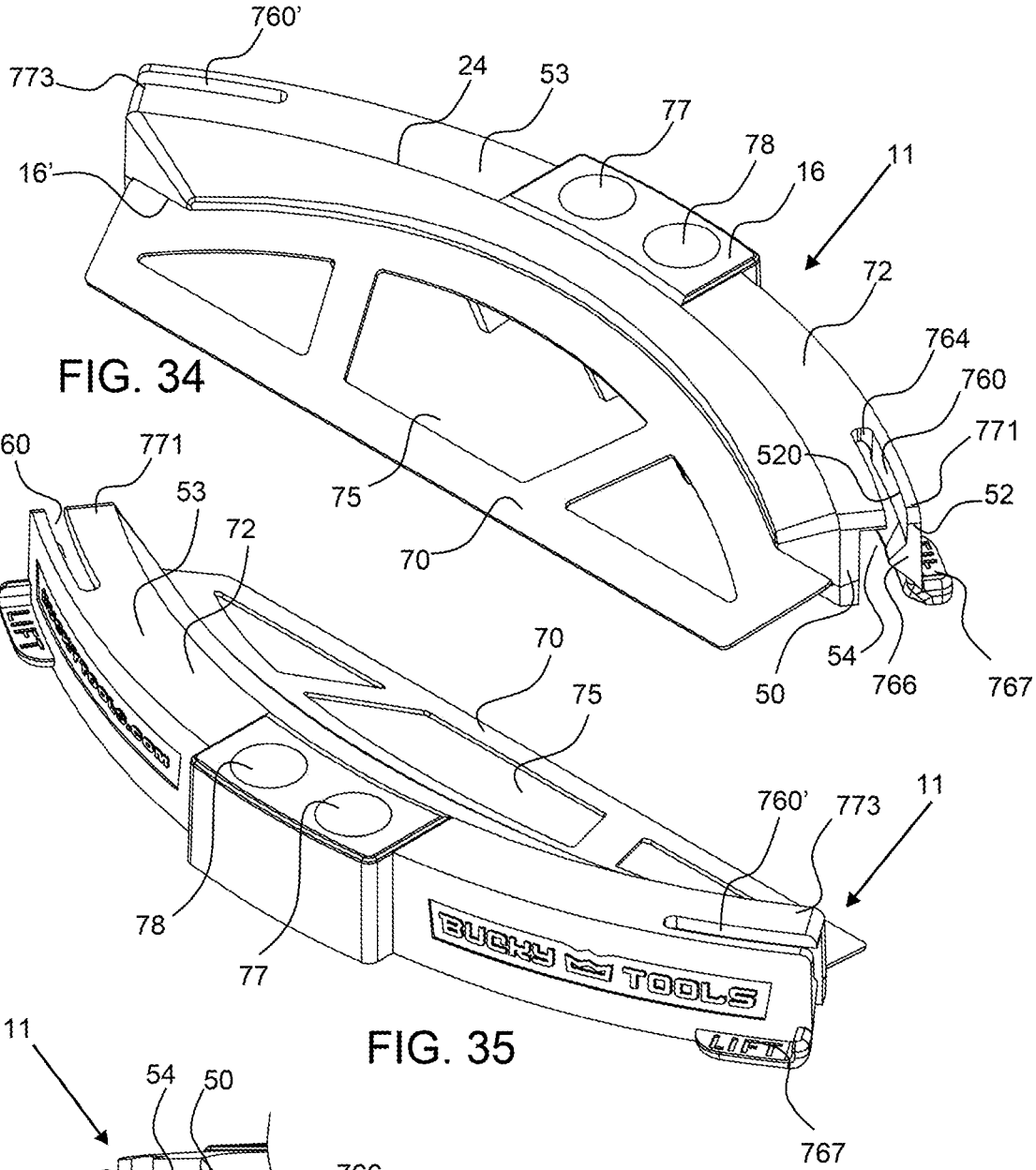
FIG. 34
FIG. 35
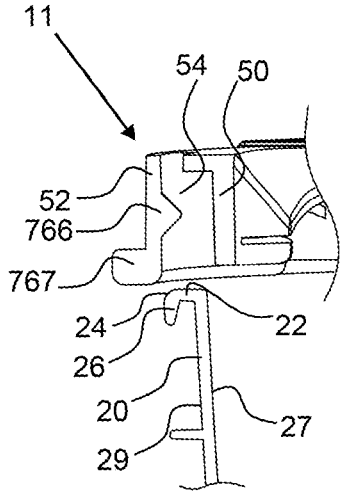
FIG. 36
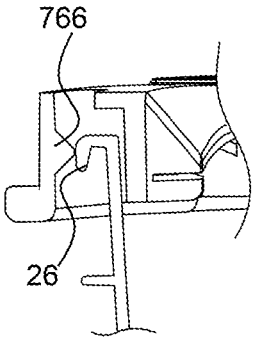
FIG. 37
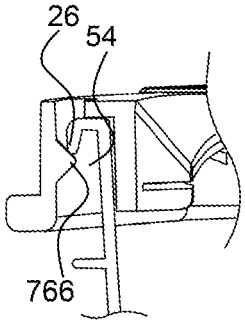
FIG. 38

DETACHABLY ATTACHABLE BUCKET IMPLEMENT COUPLER

CROSS REFERENCE TO RELATED APPLICATIONS

This application is a continuation in part of U.S. patent application Ser. No. 17/216,275, filed on Mar. 29, 2021 and currently pending, which is a continuation in part of U.S. patent application Ser. No. 16/810,888, filed on Mar. 6, 2020 and issued as U.S. Pat. No. 10,960,439 on Mar. 30, 2021; the entirety of each prior application is hereby incorporated by reference herein.

BACKGROUND OF THE INVENTION

Field of the Invention

The invention relates to a bucket implement coupler having a bucket coupler for retaining an implement, such as a scraper bar, to a bucket, such as a conventional five-gallon bucket.

Background

A bucket, such as a five-gallon bucket, is used in a wide array of functions including, painting, compound mixing, tile setting, grout application, flooring leveler application, drywall joint compound application, cleaning and the like. In many of these situations an implement is also used during the function or job. There are any number of implements that are used in conjunction with a bucket including mixing blades, drywall tools including a spackling blade, grouting tools such as a grout float, tile adhesive tools including a trowel and sponge and the like. Some of these implements may be used for spreading or applying contents within the bucket. Oftentimes, a person will insert the implement into the bucket to place material on the implement and then scrape off excess material on the side of the bucket. The material will oftentimes stick to the side of the bucket and dry. This dry material can then fall into the wet material in the bottom of the bucket and contaminate it. For example, tile adhesive may dry on the side of the bucket and fall back into the wet tile adhesive as chunks. When the wet material is retrieved from the bottom of the bucket and spread on a wall, the dry chunks both compromise the adhesion of the tile pieces and create inconsistencies in leveling from piece to piece.

SUMMARY OF THE INVENTION

The invention is directed to a bucket implement coupler that is configured to enable detachable attachment of an implement, such as a scraper bar, and/or a scraper and the like. The bucket implement coupler is detachably attachable to the top rim of a bucket. The bucket implement coupler may include a scraper bar that extends across the top opening of the bucket for scraping debris from a tool, such as a trowel. An exemplary bucket implement coupler has a rim extension having a rim slot that extends over the top rim of the bucket and wherein the scraper bar is coupled proximal to the extended ends of the rim extension. A debris aperture is configured between the scraper bar and the rim extension to allow debris to fall therethrough down into the bucket.

An exemplary rim extension has a rim slot configured between an interior flange and an exterior flange. This rim slot may be curved and may be configured to extend along a radius of curvature that is substantially the same as the top rim of the bucket or the outside surface of the bucket, wherein the radius of curvature of the rim slot is within about 30%, or preferably within about 20% and even more preferably within about 10% of the radius of curvature of the top rim or bucket outside surface. When the rim slot has a radius of curvature that is substantially the same or closely matches that of the top rim or top of the bucket, the bucket implement coupler may be more securely retained to the bucket prior to and after latching with the latch. The rim extension may extend around a portion of the top rim of the bucket, as defined by an extension angle, which may be about 180 degrees or less, about 90 degrees or less, about 75 degrees or less, about 60 degrees or less and any range between and including the extension angles provided. It is to be understood that an extension angle of 180 degrees would extend the scraper bar across the center of the bucket and this may interfere with access to the bucket contents and therefore an extension angle of 120 degrees and preferably 100 degrees or less is preferred. A rim extension may have a debris diverter, a beveled extension into the interior of the bucket. A debris diverter may extend from the top of the rim extension or from the interior flange of the rim extension and may form the rim extension boundary of the debris aperture; with the scrapper bar forming the rest of the boundary.

An exemplary bucket implement coupler is detachably attachable to a bucket. In one embodiment, the bucket implement coupler is detachably attached to the top rim of a bucket by a latch having a latch lock that engages with the bucket when the latch is pivoted down into a secure or locked configuration. An exemplary bucket implement coupler is configured to detachably attach to a top rim of a bucket by a rotating latch. The latch may be pivotably coupled in a latch slot in the latch flanges that extends down from the rim extension on the outside of the bucket. A latch may be configured in the latch slot by a latch pivot. A pivot extension may extend between the latch flanges and the latch to pivotably engage the latch in the latch slot. In an exemplary embodiment, the latch has latch extensions, cylindrical extensions that extend into apertures in the latch flanges to pivotably connect the latch in the latch slot, thereby enabling the latch to rotate in the latch slot. Note that the pivot may be reversed, wherein the latch has pivot apertures for receiving latch extensions extending from the latch flanges. In addition, a separate component, such as a pin may extend through the latch and into apertures of the latch flanges to form the pivot. The latch may have a handle that enables a user to rotate the latch from an insertion position, whereby the rim extension of the bucket implement coupler can be slid down over the top rim of the bucket, to a closed position, wherein the latch lock is rotated to engage with the bucket rim and particularly with the rim flange of the bucket, a downward extension from the top rim of the bucket. The latch lock is secured between the rim flange and the exterior surface of the bucket to retain the bucket implement coupler to the bucket. In an insertion position, the latch is rotated away from the rim slot of the bucket implement coupler to enable the bucket implement coupler to be slid down over the top rim of the bucket.

The latch may be retained by moving past a latch detent in the interior flange. This latch detent enables the latch lock to deflect the bucket into the detent to rotate past this detent. The latch is then retained by the bucket flexing back into position after being deflected. A latch detent may be a curved recessed area extending along the interior flange. The latch lock may have a latch flange, a shape that is configured to contour with the top rim or the rim flange of the bucket. A latch lock may extend in a planar direction or may be curved to match the contour of the bucket as it rotates past the detent. A latch may have a latch end that is curved and may have a radius of curvature that is substantially the same as the outside surface of the bucket; wherein the radius of curvature of the latch lock end of the latch is within about 30%, or preferably within about 20% and even more preferably within about 10% of the radius of curvature of the top rim or bucket outside surface.

In another embodiment, the bucket implement coupler is detachably attached by an attachment flange that snaps down under the rim flange of the bucket when the bucket implement coupler is aligned over the top rim of the bucket and pressed down. The attachment flange may be configured proximal to the ends of the rim extension of the bucket implement coupler and an end slot may extend along the top of the rim extension from the ends of the rim extension to allow the interior and/or exterior flange of the rim extension to flex and expand the rim slot to allow the attachment flange to slide down over the rim flange. The attachment flange may extend from the ends of the rim extension inward into the rim slot from the exterior flange. The attachment flange may be tapered to more easily allow the attachment flange to slide down over the rim flange of the bucket and then release from the bucket rim flange when desired. The attachment flange may be triangular in cross sectional shape, for example. The attachment flange may extend from the end of the rim extension some length to provide effective engagement with the rim flange to secure the bucket implement coupler to the bucket.

In an exemplary embodiment, the scraper bar is detachably attachable to the rim extension. A scraper bar may be detachably attachable to the bucket implement coupler via an implement coupling, such as a slot extending along the bucket implement coupler, or a clamp and the like. The rim extension may have a slot for receiving the scraper bar therein and an interference fit with the scraper bar may secure the scraper bar in place. In an exemplary embodiment, the rim extension comprises a bar latch that is opened to receive the scraper bar and then closed to secure the scraper bar to the rim extension. An exemplary scraper bar may be an elongated member having terminated ends, a right and left end, or may be a scraper bar assembly having a scraper bar portion that is coupled with the rim coupler that is configured to extend into a bar slot within the rim extension. The rim coupler may extend in a radius of curvature to complement the radius of curvature of the rim extension and in particular a bar slot that extends in a radius of curvature. A scraper bar assembly may provide for a more robust retention of the scraper bar by the rim extension and bar slot as a much larger area is retained versus a scraper bar having terminated ends that extend into a bar slot. An exemplary scraper bar assembly may be a monolith formed from a single part such as through injection molding, cutting and stamping a single piece of material and the like. An exemplary scraper bar or scraper bar assembly may be affixed to the rim extension, such that the rim extension and scraper bar assembly are not detachably attached. A scraper bar assembly may be a separate part that is affixed to the rim extension such as through molding, or the scraper bar may be an integral part of the rim extension, wherein the two components are a single molded part, for example.

An exemplary scraper bar may have a planar bar extension portion and a beveled portion extending therefrom. The beveled portion may extend down into a bucket when the bucket scraper apparatus is detachably attached to the top rim of the bucket. A beveled portion may extend an angle from the planar portion a beveled angle of about 15 degrees or more, about 20 degrees or more, about 40 degrees or more, such as about 25 degrees, and any range between and including the beveled angles provided.

In an exemplary embodiment, the bucket implement coupler comprises a magnetic coupler configured to retain a magnetic implement, an implement that can be retained by a magnet such as a steel implement, to the bucket implement coupler. A magnetic coupler may comprise one or more magnets that are configured on the top of the rim extension.

An exemplary bucket implement coupler may be configured to fit on a conventional five-gallon bucket, which has a rim and an outer rim diameter of about 11 ⅞ inches, or 30.16 cm. A bucket may be any size, however, and may have a top rim diameter of about 9 inches (22.86 cm) or more, about 12 inches (30.48 cm) or more, about 15 inches (38.10 cm) or more, about 20 inches (50.80 cm) or more and any range between and including the diameter values provided. The bucket implement coupler may be sized to fit over a bucket of a particular rim diameter and the rim slot and latch lock or latch lock end may be curved or have a suitable radius of curvature for the rim diameter or outer surface diameter of the bucket.

A scraper bar may have a planar surface thereby producing a sharp edge at the edge of the planar surface for removing debris from an implement. The plane of the planar surface of scraper bar may extend horizontally, or vertically. In a vertical orientation, the scraper bar may be more resistant to downward force due to moment of inertia geometry factors.

The summary is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

FIG. 17 shows a front view of an exemplary latch having a radius of curvature that substantially matches the diameter of the bucket it is configured for attachment to.

FIG. 18 shows a perspective view of an exemplary latch having a radius of curvature that substantially matches the diameter of the bucket it is configured for attachment to.

FIG. 34 shows a perspective view of the bucket implement coupler shown in FIG. 32 having an end slot along the top 53 of the rim extension, on both the left and right sides of the rim extension to enable flexing of the exterior flange to allow the attachment flange to detachably couple with the rim flange of the bucket.

FIG. 35 shows a perspective view of the bucket implement coupler shown in FIG. 32 having a release flange extending out from the exterior flange of the bucket implement coupler to deflect the exterior flange and release the attachment flange from the rim flange of the bucket.

FIGS. 36, 37 and 38 show a side cross sectional view of the bucket implement coupler shown in FIG. 32 being pushed down over the top rim of a bucket and the exterior flange deflecting to outward to enable the attachment flange to engage with the rim flange of the bucket.

Figure 1:
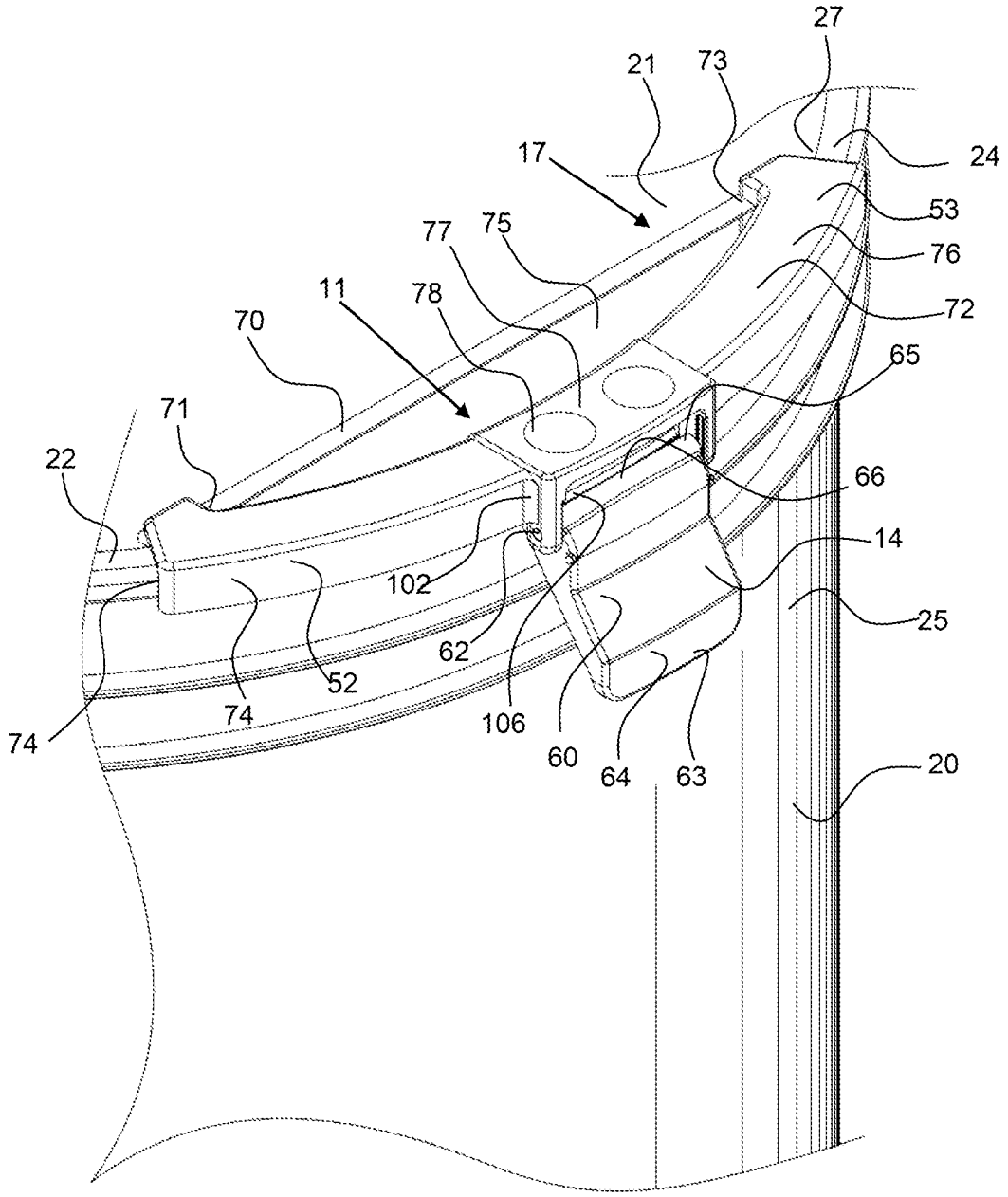
FIG. 1 shows a perspective view of an exemplary bucket implement coupler, an implement scraper, having a bucket coupler for detachably attaching the bucket implement coupler to the top rim of the bucket with the scraper bar extending across a portion of the top opening of the bucket and forming a debris aperture between the scraper blade and the rim extension to allow the debris to fall therethrough down into the bucket and a magnetic coupler for retaining a scraper implement, having metallic portions, such as the scraper blade to the implement scraper.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components.

Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, uses of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, an exemplary bucket implement coupler 11, an implement scraper 17, has a bucket coupler 14 for detachably attaching the bucket implement coupler 11 to the bucket 20. The bucket coupler has a latch 60 with a latch handle 64 that rotates about a latch pivot 62 to secure the latch lock 66 on the latch end 65 against the bucket, such as against the top rim 24 of the bucket. The implement scraper is configured with the scraper bar 70 extending across the top opening 21 of the bucket. The scraper extends from the right end 73 coupled with right rim extension to the left end 71 coupled with the left rim extension 74 and forms a debris aperture 75 between the scraper blade and the interior surface 27 of the wall 25 of the bucket 20 to allow the debris to fall therethrough, down into the bucket. The rim extension has an interior flange configured down along the interior of the bucket and an exterior flange 52 configured down over the exterior of the top rim of the bucket. This rim extension forms a rim slot that extends over the top rim of the bucket. The bucket implement coupler 11 is configured with magnetic coupler 77 having magnets 78 for retaining a scraper implement having metallic portions, such as a metallic trowel, to the bucket implement coupler 11.

Figure 2:
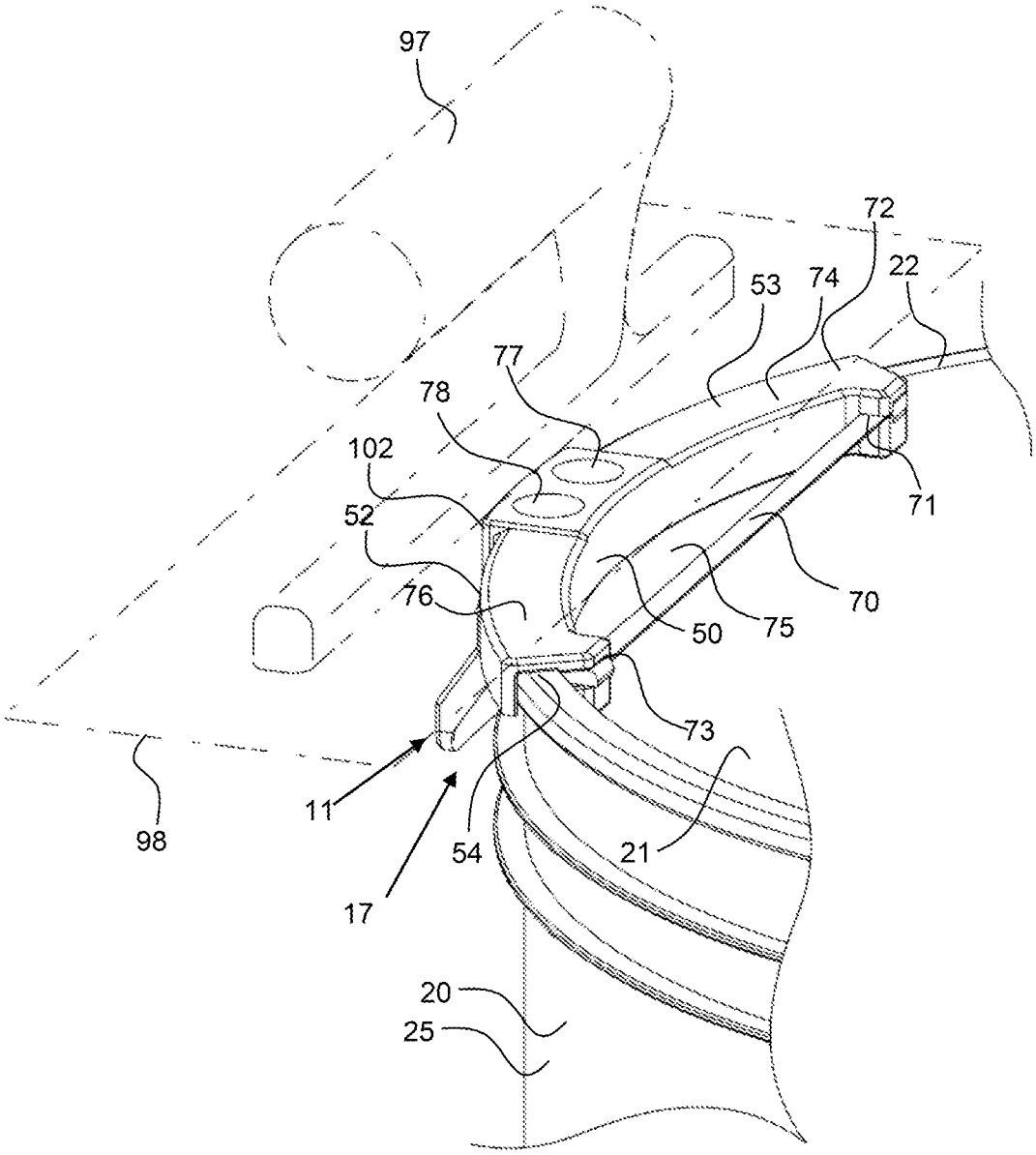
FIG. 2 shows a perspective view of the exemplary bucket implement coupler, an implement scraper, having a scraper implement retained to the implement scraper by the magnetic coupler.
Figure 3:
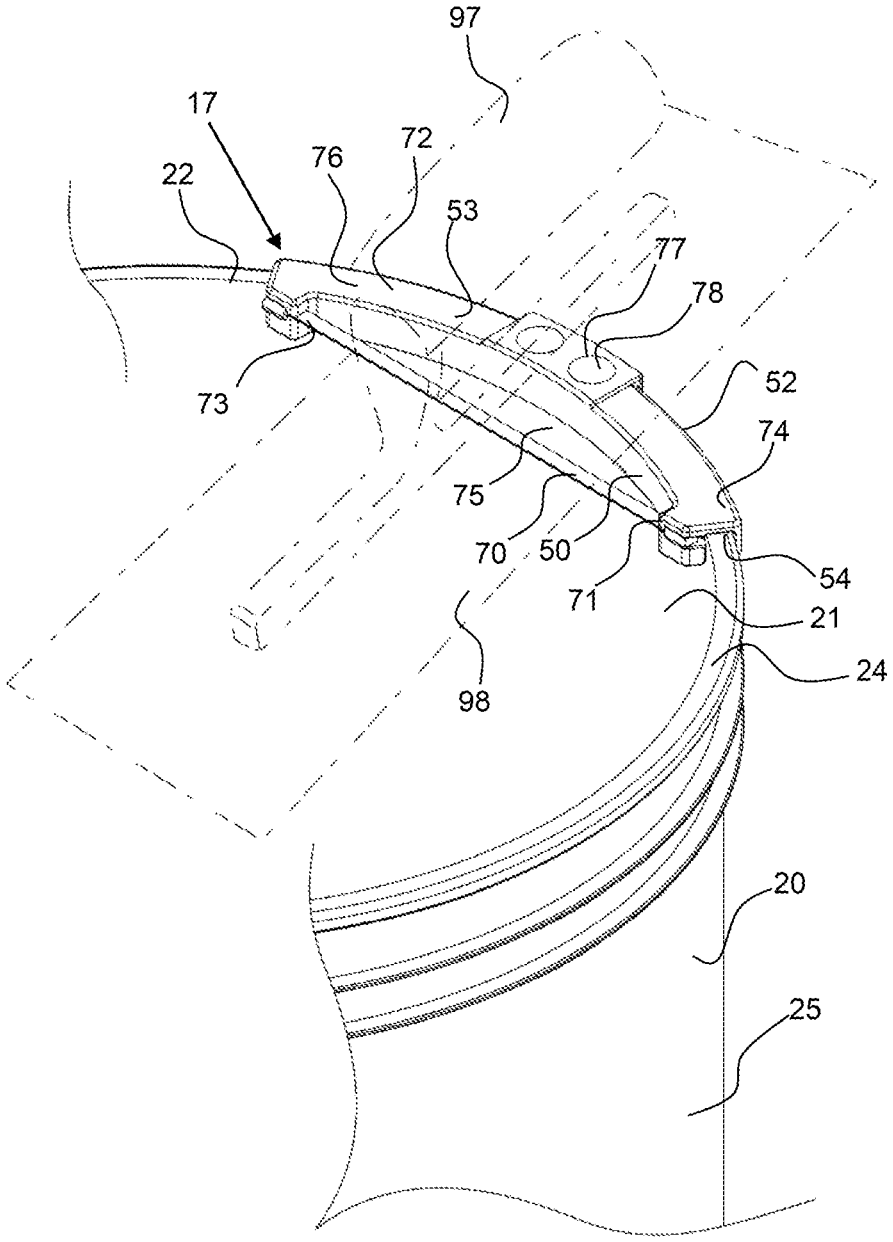
FIG. 3 shows a top perspective view of a scraper implement retained to the implement scraper by the magnetic coupler

Referring now to FIGS. 2 and 3, a scraper implement 97 is secured to the bucket implement coupler 11, an implement scraper 17, by the magnetic coupler 77. The scraper blade 98 of the scraper implement is metal, a magnetic implement, and is retained to the magnets 78 of the magnetic coupler. A worker may place a trowel on top of the magnetic coupler of the implement scraper while performing other tasks associated with the job. This protects the trowel from falling into the mixed compound in the bucket. Also shown in FIGS. 2 and 3 is the rim extension having a rim slot 54 formed by the interior flange 50, the rim extension top 53 and the exterior flange 52. The rim slot is configured with a radius of curvature to enable the implement scraper to be placed and retained over the top rim of the bucket.

Figure 4:
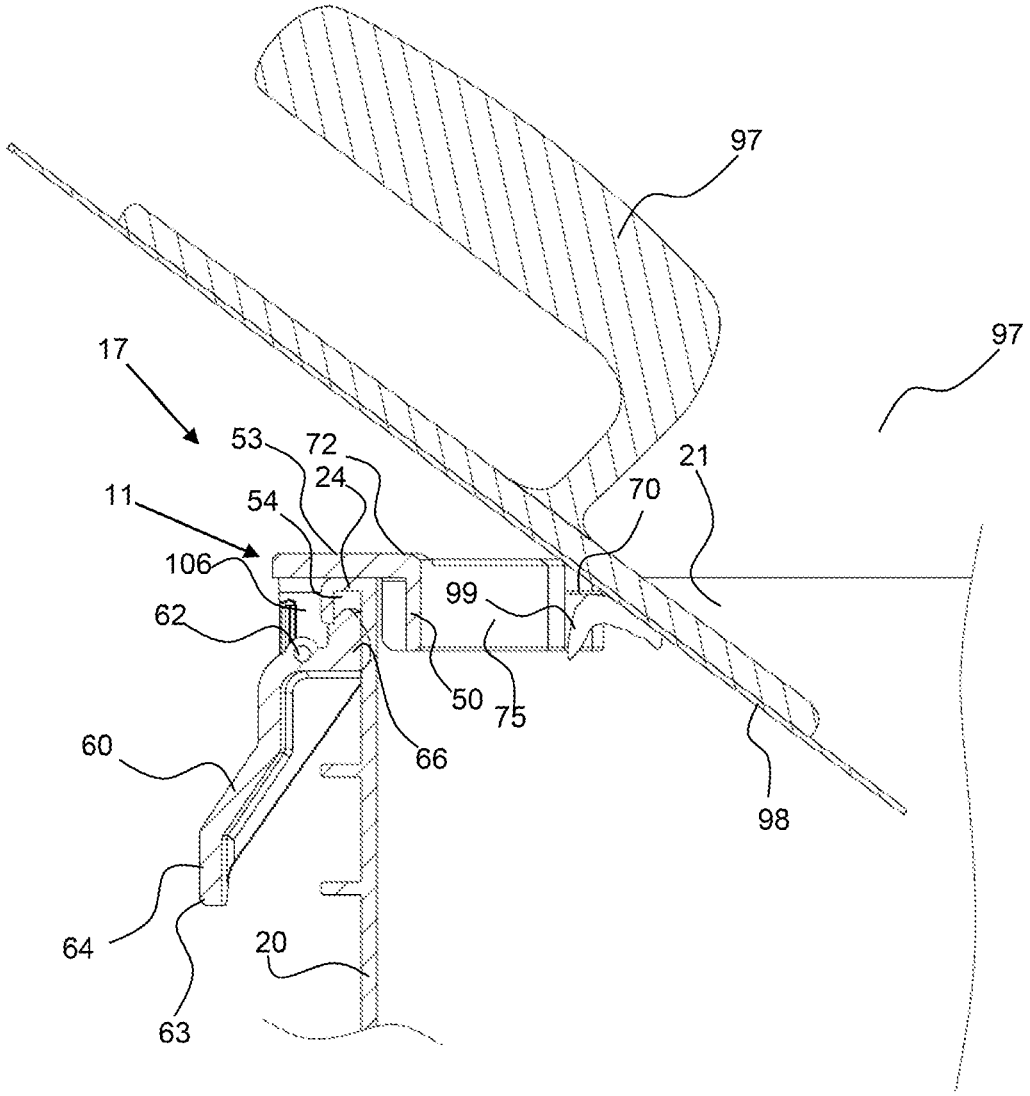
FIG. 4 shows a side cross sectional view of an exemplary bucket implement coupler, an implement scraper, and a scraper implement scraping debris off of the scraper blade along the scraper bar and debris falling off of the scraper bar and into the bucket.
Figure 5:
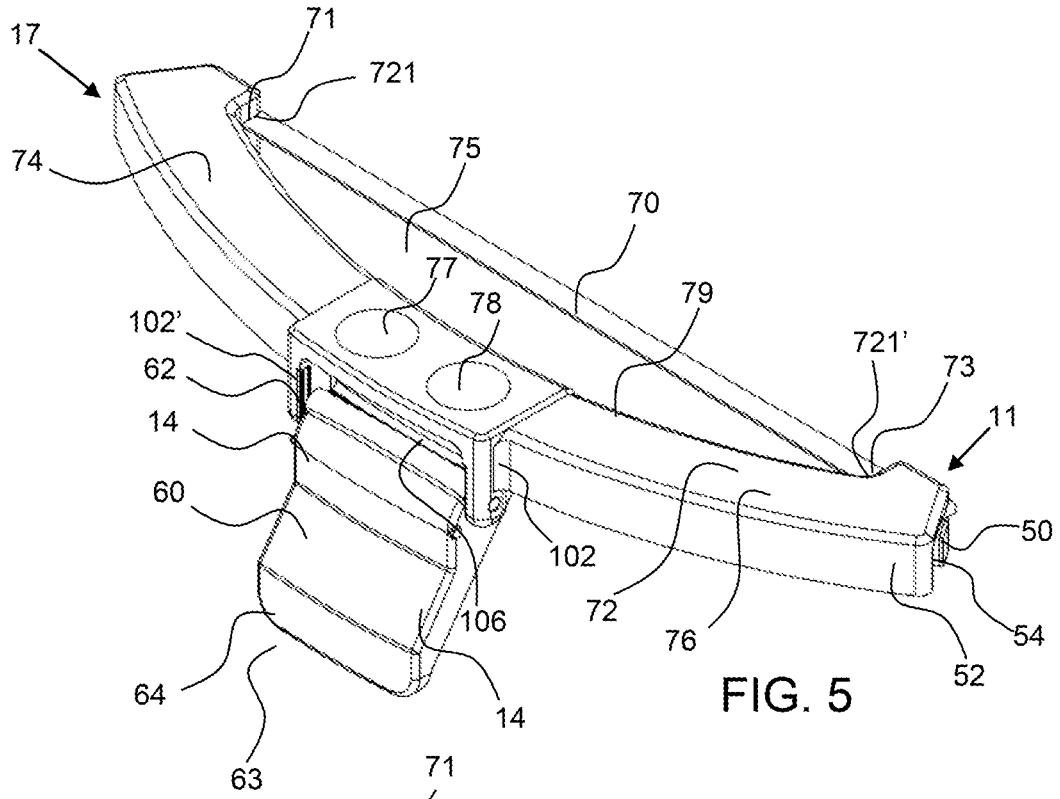
FIG. 5 shows a perspective view of an exemplary implement scraper.

As shown in FIG. 4, a scraper implement 97 is scraping debris 99 off of the scraper blade 98 along the scraper bar 70 and debris is falling off of the scraper bar and into the bucket 20. Debris may be scraped such that it falls between the scraper bar and the top opening 21 of the bucket and may fall through the debris aperture 75 formed between the scraper bar 70 and the rim extension 72 of the bucket coupler 17.

Figure 6:
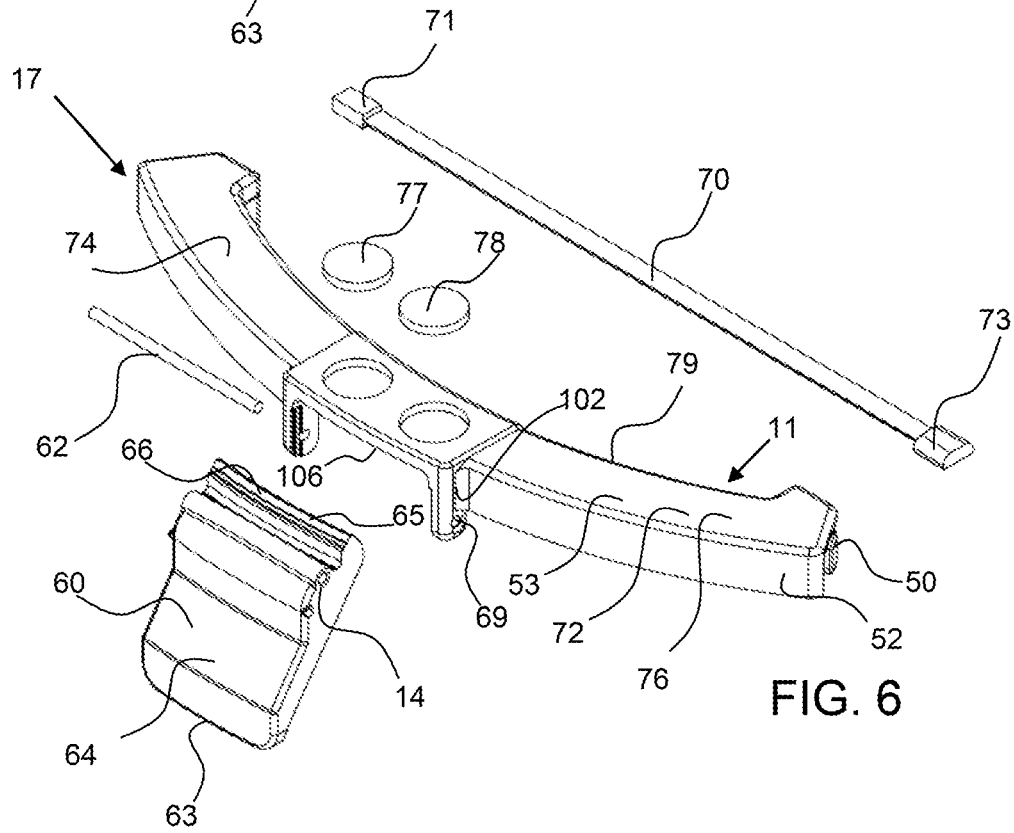
FIG. 6 shows an exploded view of an exemplary implement scraper.
Figure 7:
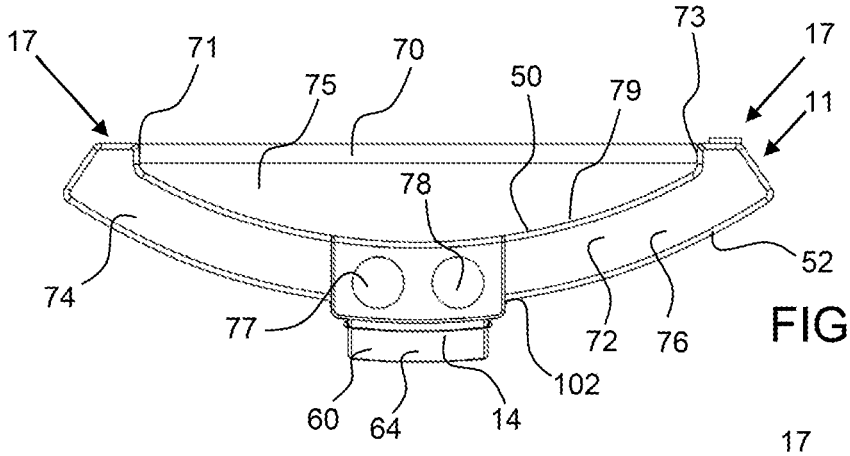
FIG. 7 shows a top view of an exemplary implement scraper.
Figure 8:
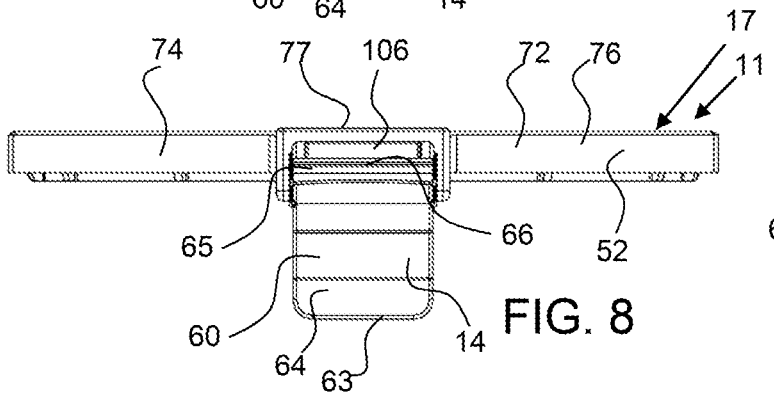
FIG. 8 shows a back view of an exemplary implement scraper.
Figure 9:
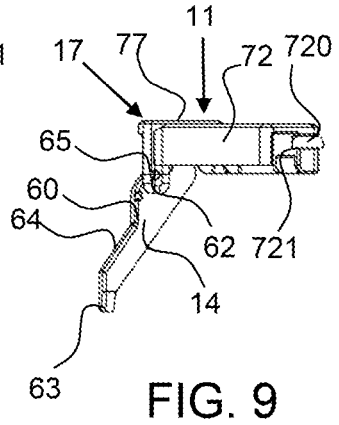
FIG. 9 shows a side view of an exemplary implement scraper.
Figure 10:
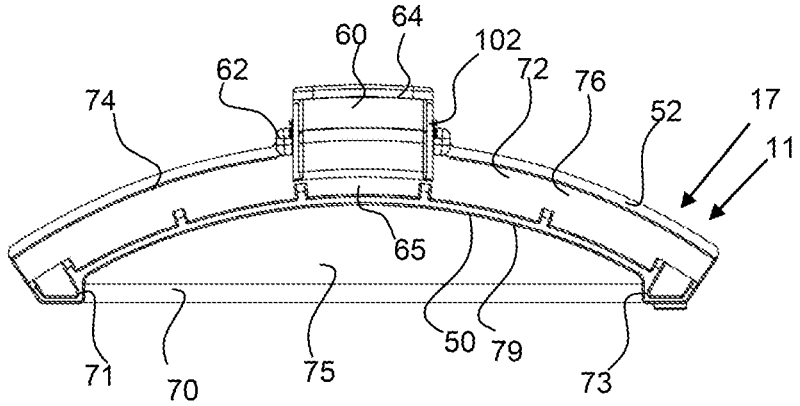
FIG. 10 shows a bottom view of an exemplary implement scraper.
Figure 11:
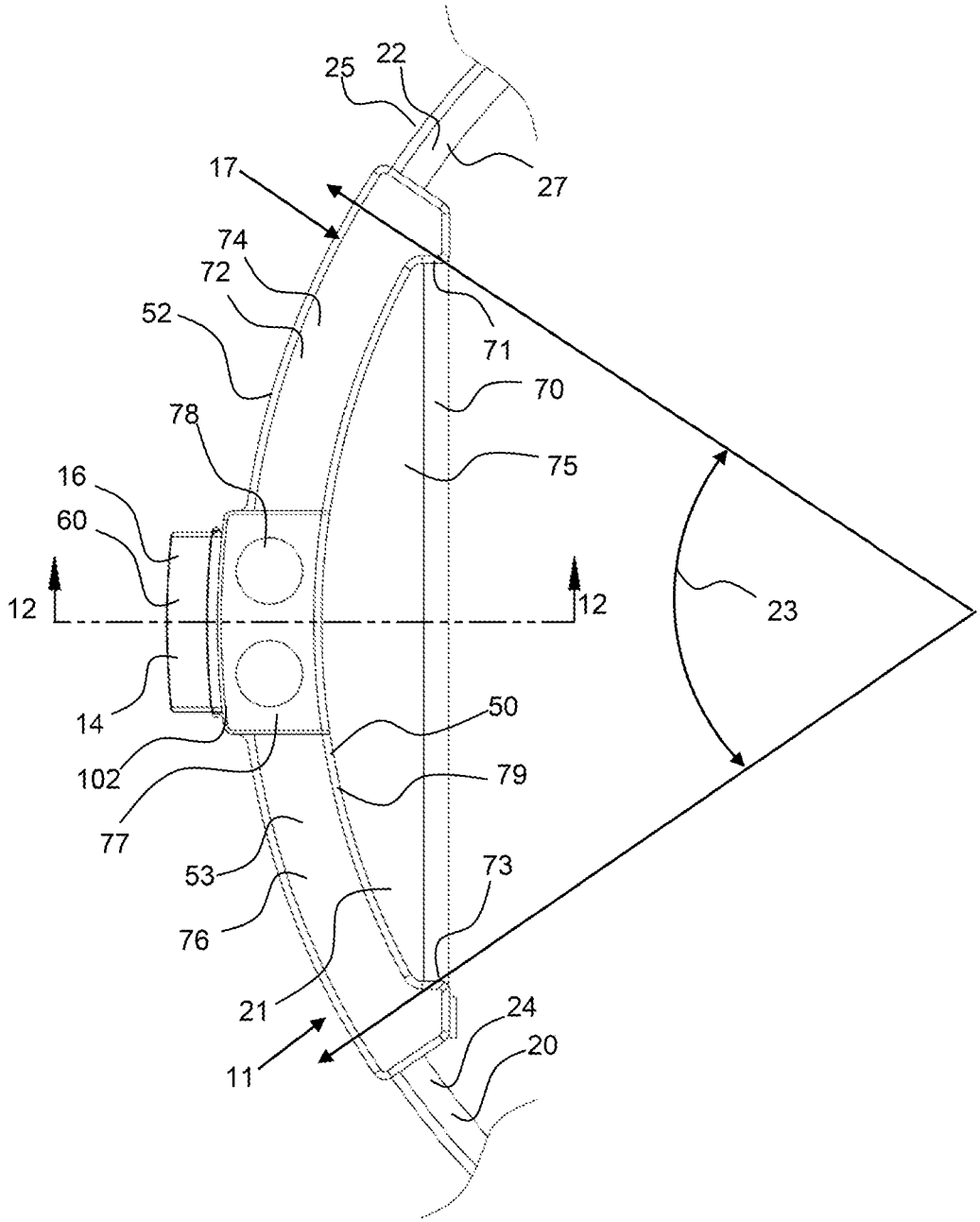
FIG. 11 shows a top view of an exemplary bucket implement coupler, an implement scraper, and the debris aperture formed between the scraper bar and the inner surface of the wall of the bucket or the interior flange of the rim extension.

Referring to FIGS. 5 to 11, an exemplary bucket implement coupler 11, an implement scraper 17, has a rim extension 72 that is coupled to a top rim of a bucket. A left rim extension 74 extends circumferentially to the left from the bucket coupler 14 and magnetic coupler 77 and a right rim extension 76 extends to the right from the bucket coupler and magnetic coupler. A magnetic coupler 77 is configured on the top of the bucket implement coupler 11 and has a pair of magnets 78 for retaining a scraper implement, or any other magnetic implement. The bucket coupler 14 has a latch 60 configured to detachably attach the bucket implement coupler 11 to the bucket. The latch handle 64 is configured to rotate about a latch pivot 62 to bring the latch lock end 65, and the latch lock 66 into engagement with the bucket, such as against the top rim of the bucket. The handle end 63 is rotated down to engage the latch lock with the bucket rim. The latch handle pivots within a latch slot 106 formed by the two opposing latch flanges extending down from the exterior flange. As shown in FIG. 6, the latch pivot 62, employs pivot extensions extending into latch pivot apertures 69 in the latch flanges 102. The scraper bar 70 is configured to extend across a top opening of a bucket and has a left end 71 and a right end 73 that are coupled proximal to the ends of the left rim extension and right rim extension, respectively. As shown in FIGS. 5, 7, 10, and 11, the scraper bar forms a debris aperture 75 between the scraper bar and the inside surface of the top extension 79 and the interior surface 27 of the wall 25 of the bucket. As shown in FIG. 11, the scraper blade extends an extension angle 23 around the outer circumference of the top rim 24 of the bucket. The extension angle shown is about 60 degrees.

Figure 12:
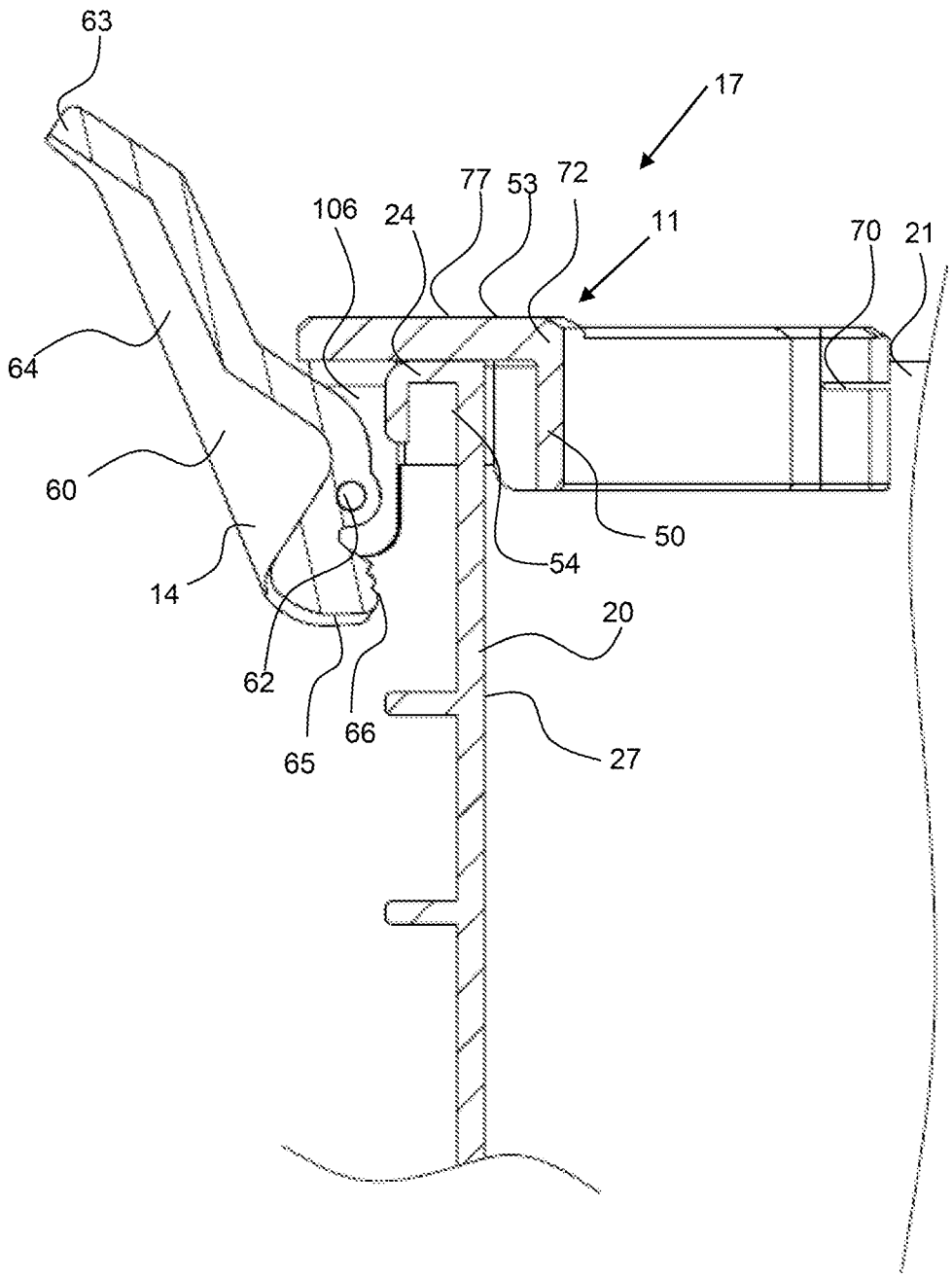
FIG. 12 shows a side cross sectional view of an exemplary bucket implement coupler, an implement scraper, configured on the top rim of a bucket with the latch in an open configuration.
Figure 13:
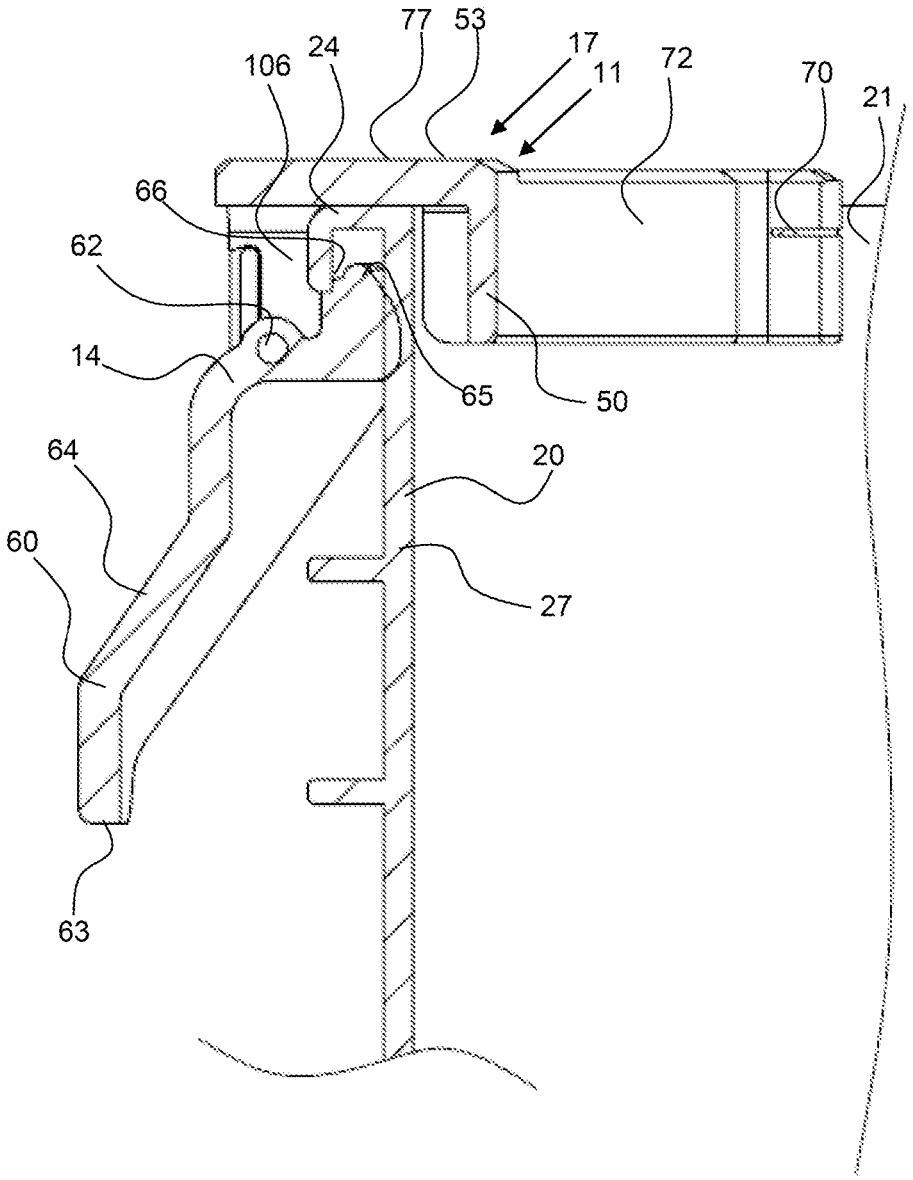
FIG. 13 shows a side cross sectional view of an exemplary bucket implement coupler, an implement scraper, configured on the top rim of a bucket with the latch in a down and secured or latched configuration.

Referring now to FIGS. 12 and 13, an exemplary bucket implement coupler 11 is configured on the top rim 24 of a bucket 20 with the rim slot 54 configured over the top rim of the bucket. In FIG. 12, the latch 60 is in an open configuration with the handle end 63 of the latch handle 64 rotated up and the latch lock end 65 and latch lock 66 rotated down away from the bucket. In FIG. 13, the latch handle 64 of the latch 60 is rotated about the latch pivot 62 to bring the latch lock end 65 and latch lock 66 into engagement with the top rim 24 of the bucket 20.

Figure 14:
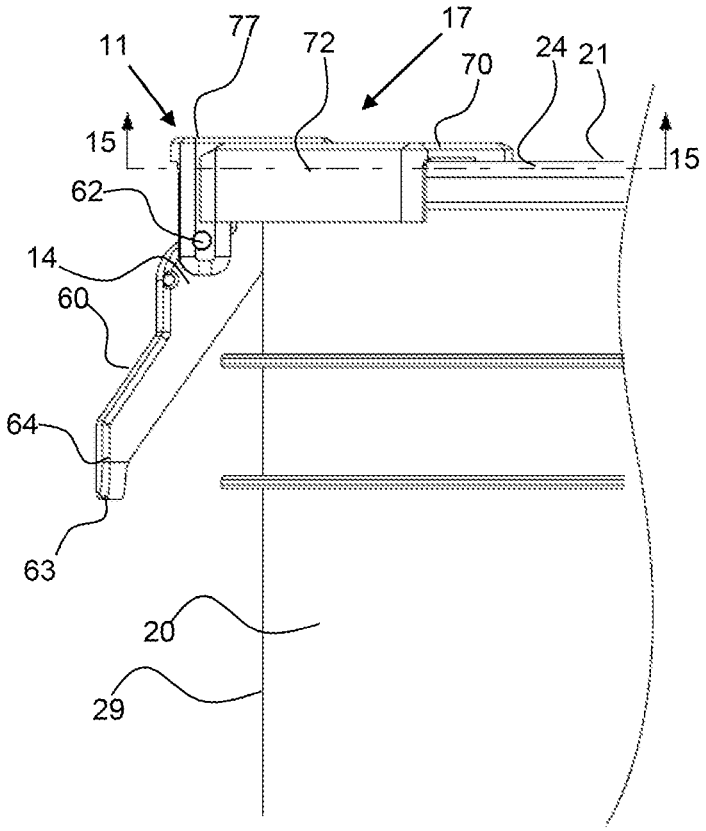
FIG. 14 shows a side view of an exemplary bucket implement coupler, an implement scraper, configured on the top rim of a bucket with the latch in a down and secured or latched configuration.

As shown in FIG. 14, an exemplary bucket implement coupler 11 is configured on the top rim 24 of a bucket 20 with the latch in a down and secured or latched configuration.

Figure 15:
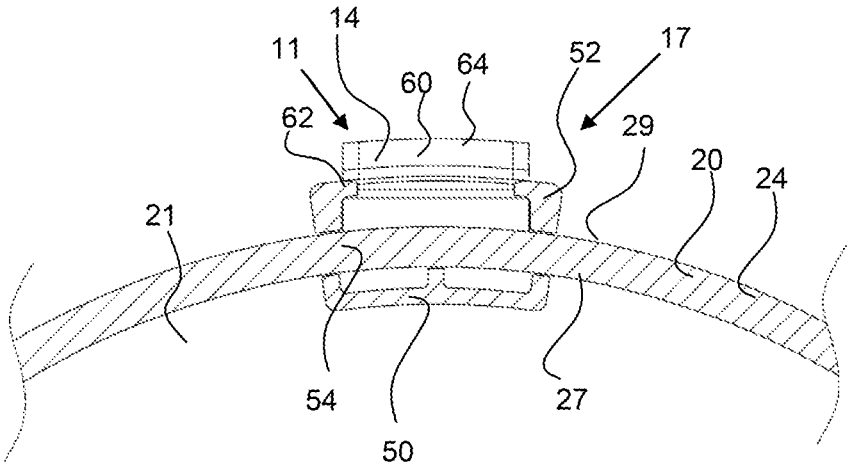
FIG. 15 shows a cross sectional view along line 15-15 of FIG. 14, of the implement scraper, not including the scraper bar, configured on the top rim of a bucket with the latch in a down and secured or latched configuration.

As shown in FIG. 15, the bucket implement coupler 11 is configured on the top rim 24 of a bucket 20, with the latch 60 in a down and secured or latched configuration. The rim slot 54 is a slot in the bucket implement coupler 11 that extends over the top rim of the bucket from the interior surface 27 to the exterior surface 29.

Figure 16:
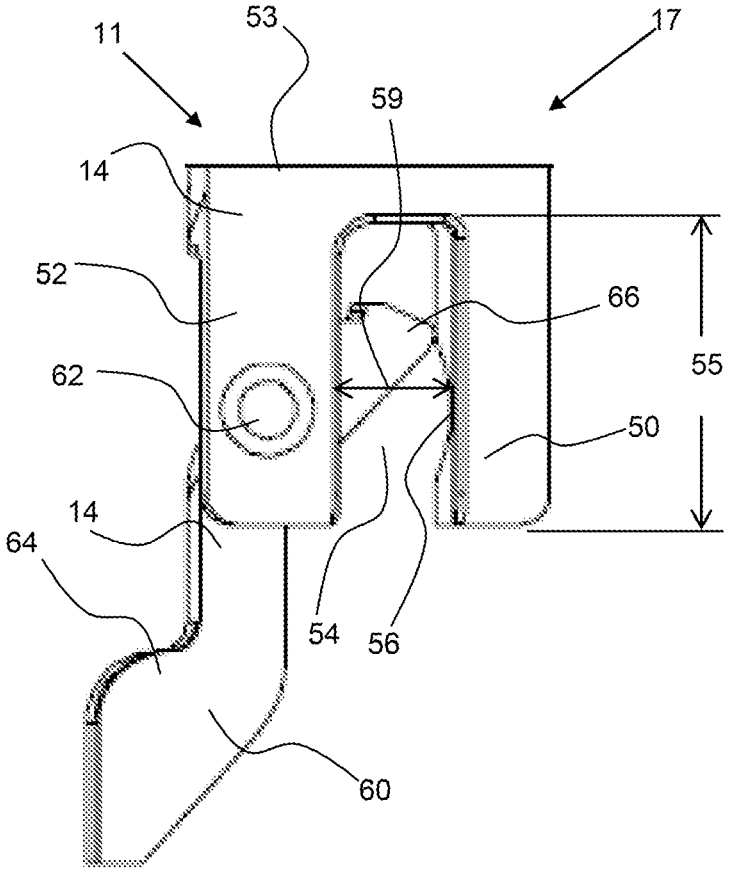
FIG. 16 shows a side view of an exemplary bucket coupler portion of a bucket implement coupler, an implement scraper.

Referring now to FIG. 16, the latch 60 is configured to rotate from an open position to a closed or locked position. The rim slot 54 is slightly wider than the top rim of the bucket and the width of the rim slot at the detent 56 is wider than the width of the rim slot above and below the detent. This detent allows the bucket wall to flex into the detent as the latch lock end of the latch handle 64 rotates up along the detent to provide a positive engagement past the detent to secure the bucket coupler 14 and bucket implement coupler 11 to the bucket. The detent slot width 59 is greater than the width of the rim slot 54 above and below the detent, as shown.

Figure 17:
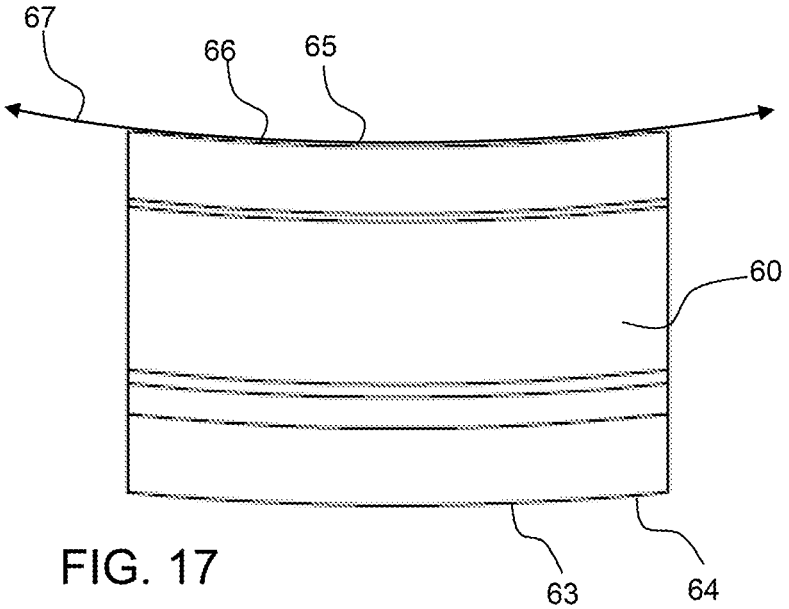
Figure 18:
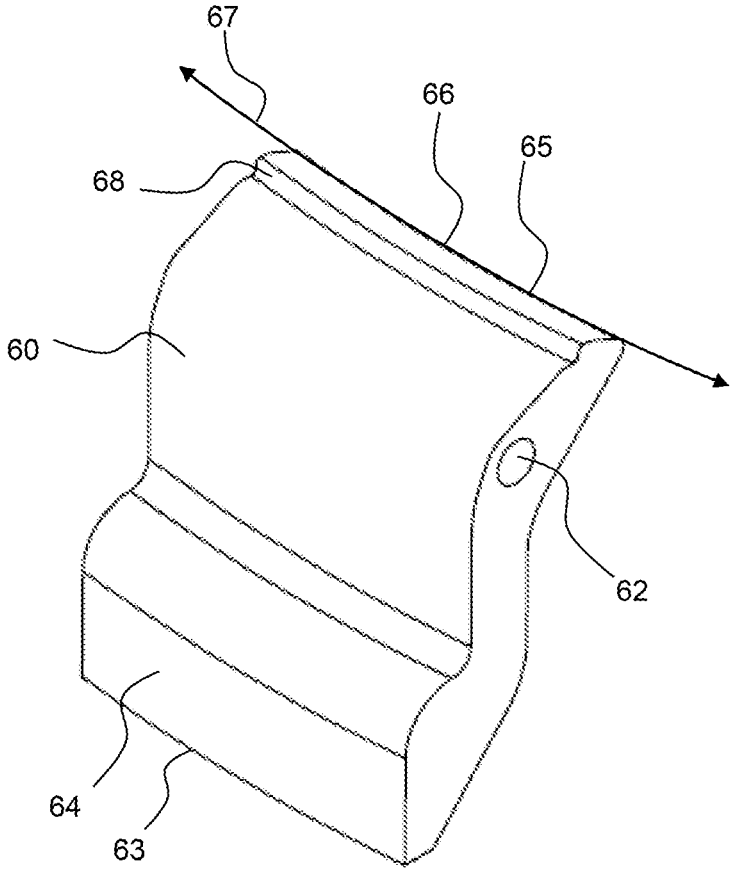

Referring now to FIGS. 17 and 18, an exemplary latch 60 has a latch lock end 65 that has a radius of curvature 67 that may correspond substantially, within about 30% and preferably within about 20%, and more preferably within about 10%, of a radius of curvature of the outside surface of a bucket or the bucket rim, to enable the latch lock to slide along the outside surface of the bucket and past the latch detent in the interior flange, as shown in FIG. 16. As shown in FIG. 18 the latch pivot includes a pivot aperture in the latch handle 64. Also, the latch lock end 65 comprises a latch lock 66 and latch flange 68, configured to abut with a downward extension of the top rim of the bucket.

Figure 19:
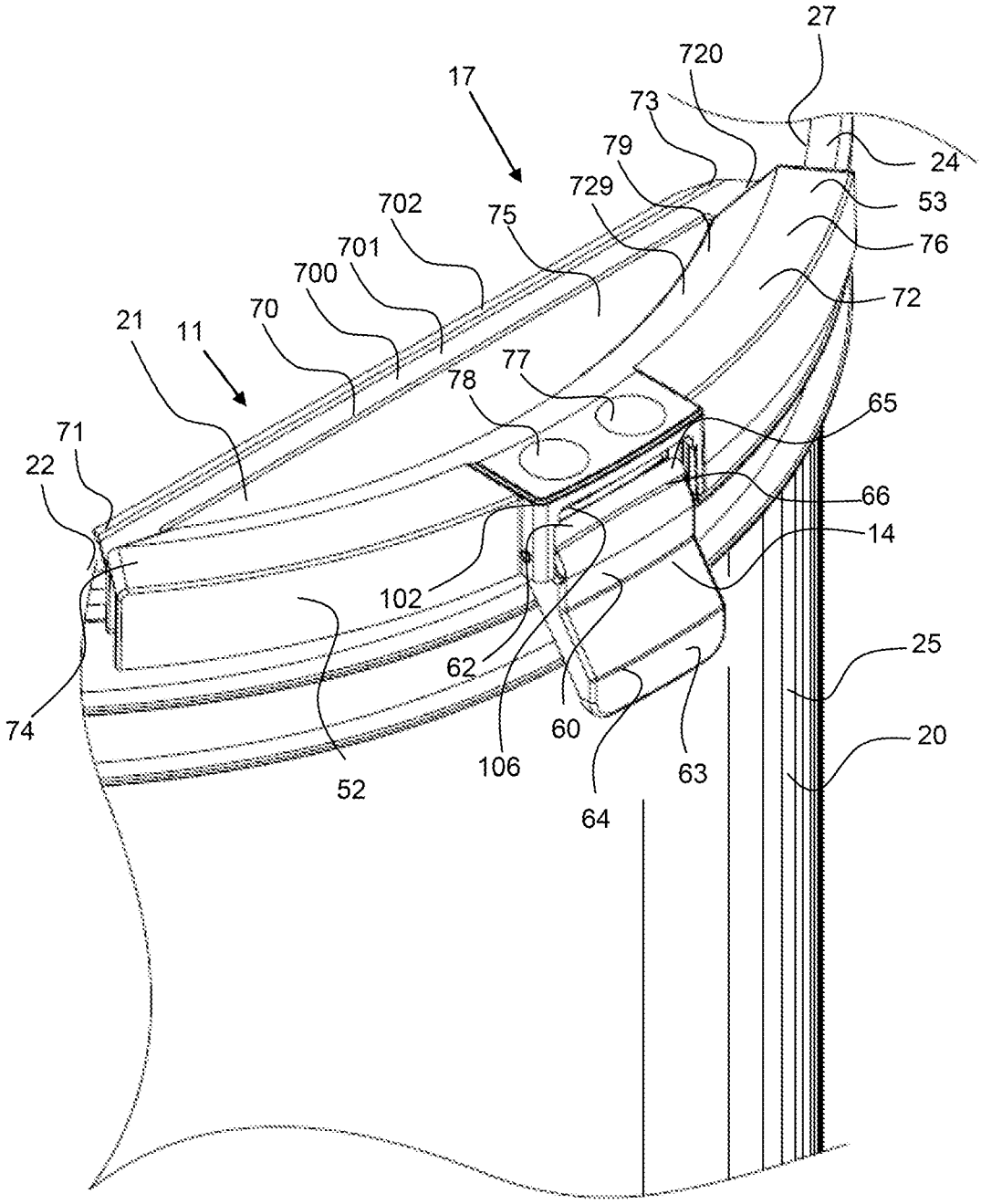
FIG. 19 shows a perspective view of an exemplary bucket implement coupler, an implement scraper, having a bucket coupler for detachably attaching the implement scraper to the top rim of the bucket with the scraper bar extending across a portion of the top opening of the bucket and forming a debris aperture between the scraper blade and the rim extension to allow the debris to fall therethrough down into the bucket and a magnetic coupler for retaining a scraper implement, having metallic portions, such as the scraper blade of the implement scraper.

As shown in FIG. 19, an exemplary bucket implement coupler 11, an implement scraper 17, has a bucket coupler 14 for detachably attaching the bucket implement coupler to the bucket 20. The bucket coupler has a latch 60 with a latch handle 64 that rotates about a latch pivot 62 to secure the latch lock 66 on the latch end 65 against the bucket, such as against the top rim 24 of the bucket. The implement scraper is configured with the scraper bar 70 extending across the top opening 21 of the bucket. The scraper bar is part of the scraper bar assembly that includes rim coupler 720 that is retained in a rim slot within the rim extension 72. The scraper bar extends from the right end 73 coupled with right rim extension to the left end 71 coupled with the left rim extension 74 and forms a debris aperture 75 between the scraper blade and the interior surface 27 of the wall 25 of the bucket 20 to allow the debris to fall therethrough, down into the bucket. The rim extension has a debris diverter 720, a downward beveled portion of the inside surface 79 of the rim extension or an extension from the rim extension 72. This beveled debris diverter may funnel debris into the inside of the bucket. The rim extension has an interior flange configured down along the interior of the bucket and an exterior flange 52 configured down over the exterior of the top rim 24 of the bucket. This rim extension forms a rim slot that extends over the top 22 or top rim of the bucket. The bucket implement coupler 11 is configured with magnetic coupler 77 having magnets 78 for retaining a scraper implement having metallic portions, such as a metallic trowel, to the bucket implement coupler.

Figure 20:
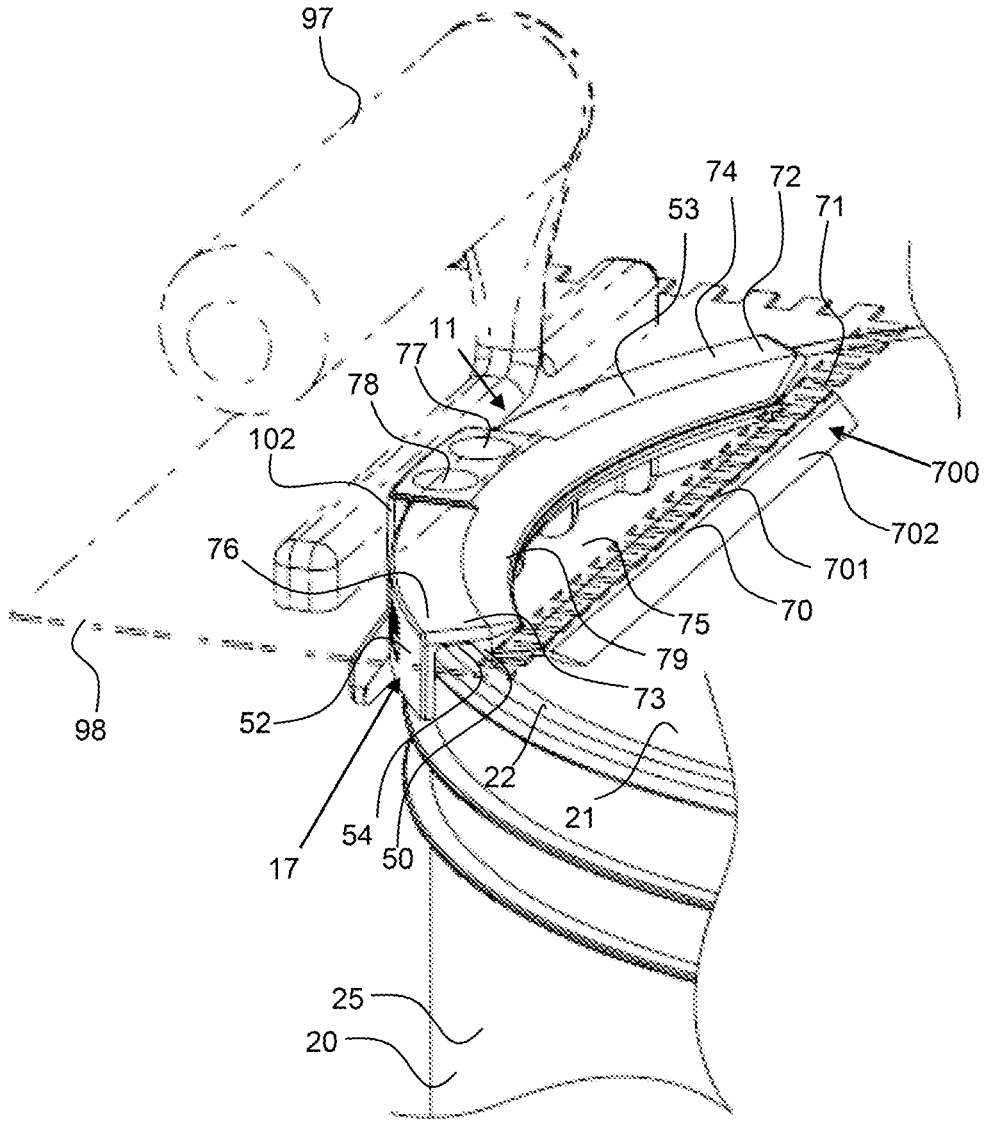
FIG. 20 shows a perspective view of the exemplary implement scraper having a scraper implement retained to the implement scraper by the magnetic coupler.
Figure 21:
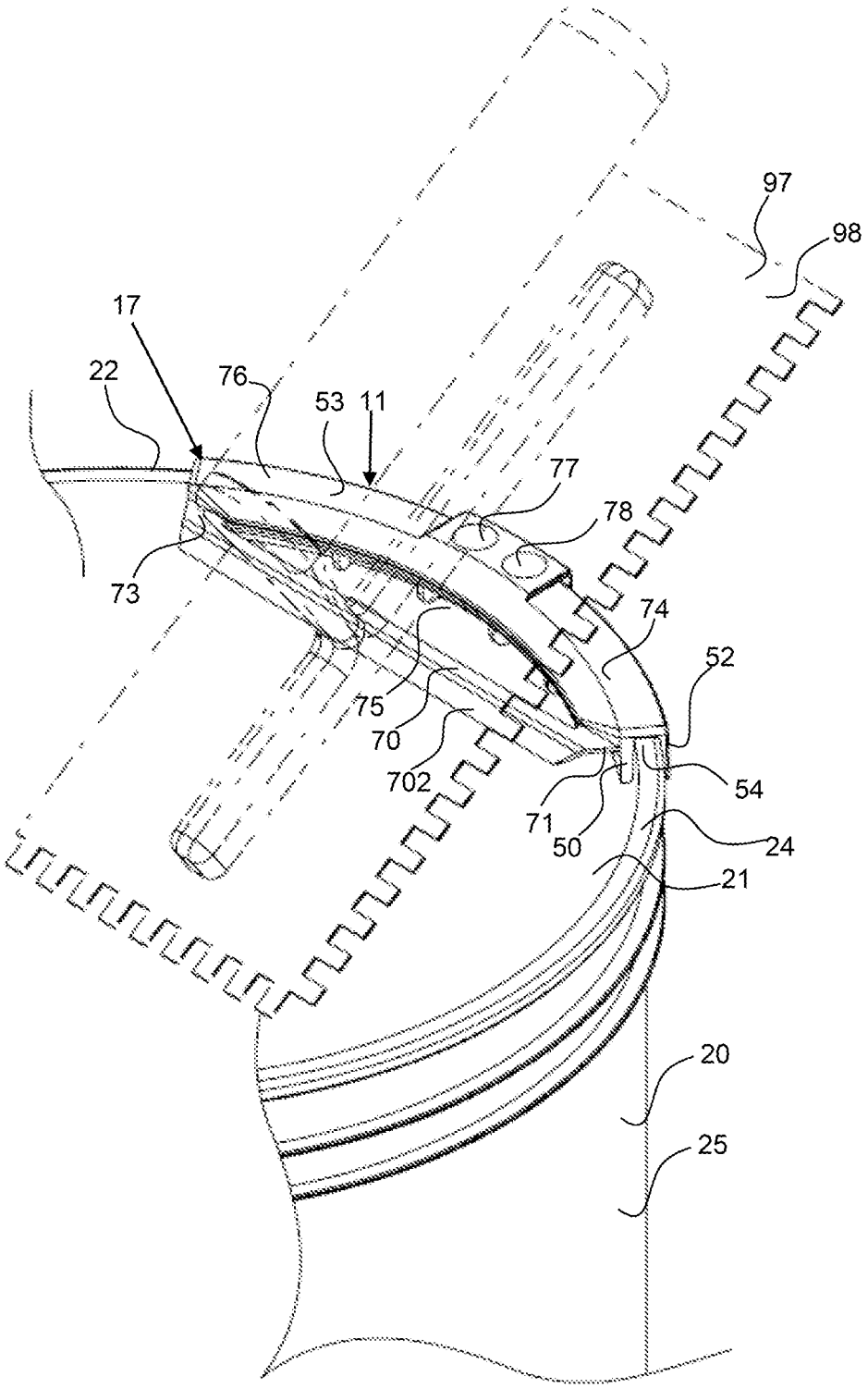
FIG. 21 shows a top perspective view of a scraper implement positioned against the scraper bar.

Referring now to FIGS. 20 and 21, a scraper implement 97 may be secured to the bucket implement coupler 11 by the magnetic coupler 77. The scraper blade 98 of the scraper implement is metal, a magnetic implement, and is retained to the magnets 78 of the magnetic coupler. A worker may place a trowel on top of the magnetic coupler of the bucket implement coupler 11 while performing other tasks associated with the job. This protects the trowel from falling into the mixed compound in the bucket. Also shown in FIGS. 20 and 21 is the rim extension 72 having a rim slot 54 formed by the interior flange 50, the rim extension top 53 and the exterior flange 52. The rim slot is configured with a radius of curvature to enable the bucket implement coupler to be placed and retained over the top rim of the bucket. The scraper bar assembly 700 is a monolithic component with the scraper bar 70 being integrally formed with the rim coupler that is retained within a bar slot in the rim extension 72. The scraper bar has a beveled portion 702 that extends downward from the planar bar extension 701, which may extend substantially horizontally; when the bucket is on a horizontal surface.

Figure 22:
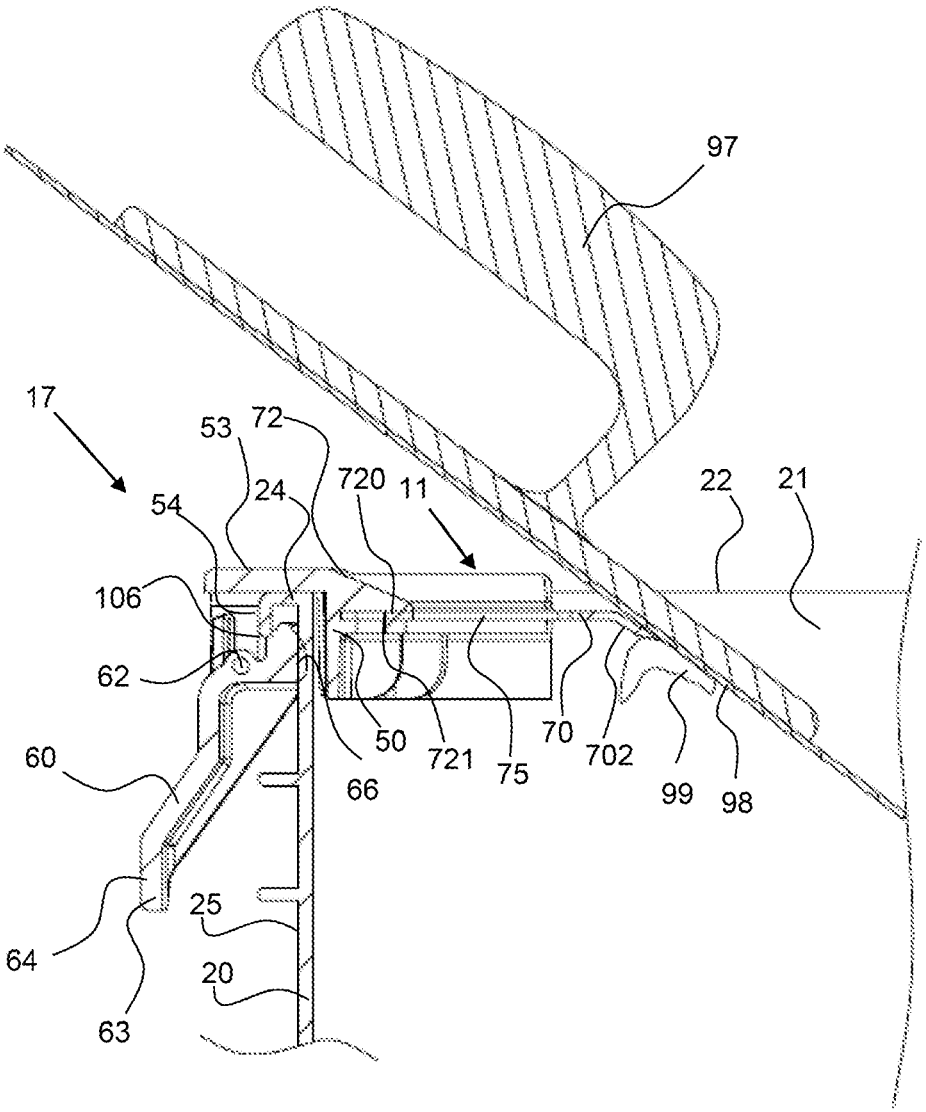
FIG. 22 shows a side cross sectional view of an exemplary bucket implement coupler, an implement scraper, and a scraper implement scraping debris off of the scraper blade along the scraper bar and beveled portion of the scraper bar and debris falling off of the scraper bar into the bucket.
Figure 23:
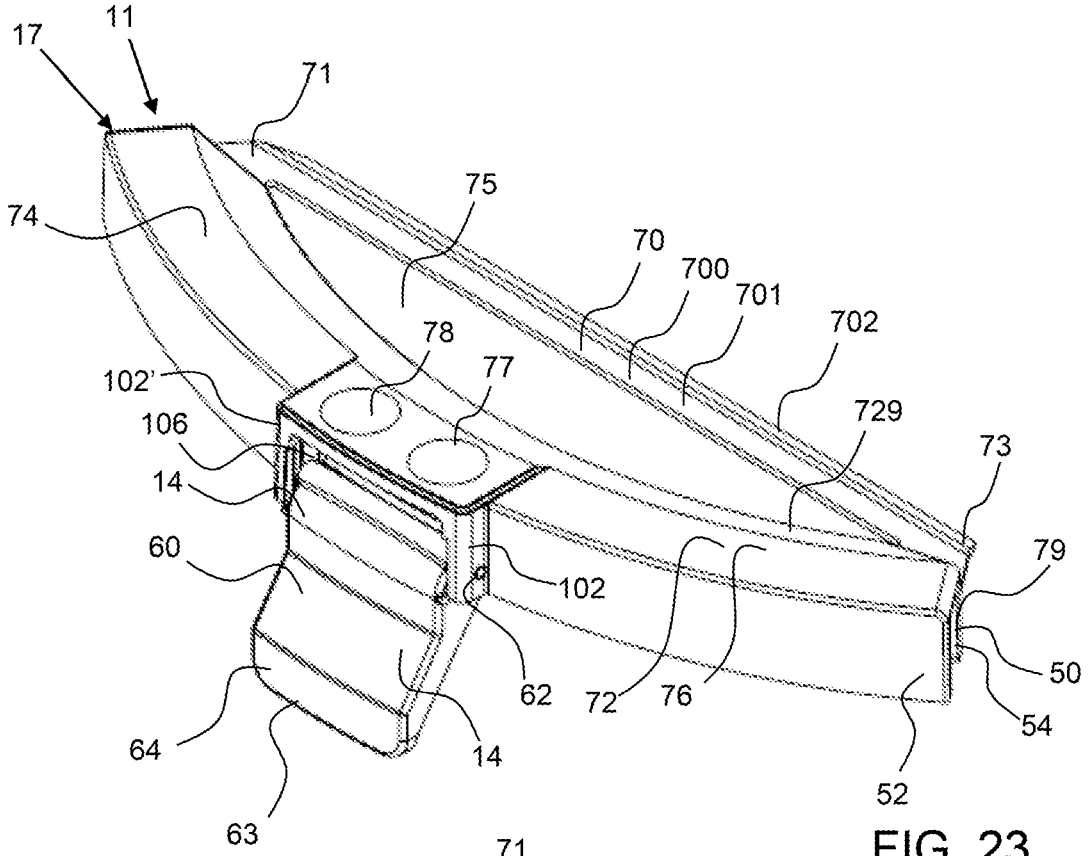
FIG. 23 shows a perspective view of an exemplary implement scraper.

As shown in FIG. 22, a scraper implement 97 is scraping debris 99 off of the scraper blade 98 along the scraper bar 70 and the beveled portion 702 of the scraper bar and debris is falling off of the scraper bar and into the bucket 20. Debris may be scraped such that it falls between the scraper bar and the top opening 21 of the bucket and may fall through the debris aperture 75 formed between the scraper bar 70 and the rim extension 72 of the bucket coupler 17. Also shown in FIG. 22, the scraper bar assembly 700 is secured to the rim extension 72 with the rim coupler 720 configured in the bar slot 721 of the rim coupler.

Figure 24:
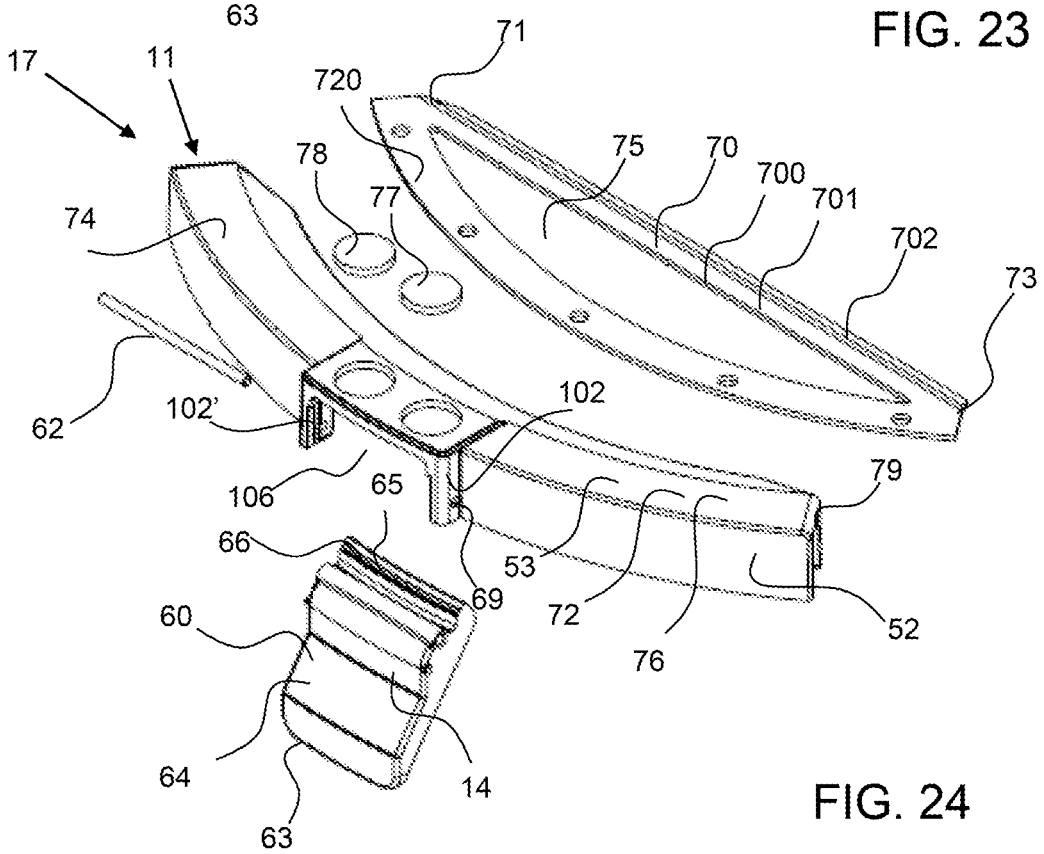
FIG. 24 shows an exploded view of an exemplary implement scraper having a scraper bar assembly with a rim coupler that extends a radius of curvature for insertion into a bar slot of the rim extension.
Figure 25:
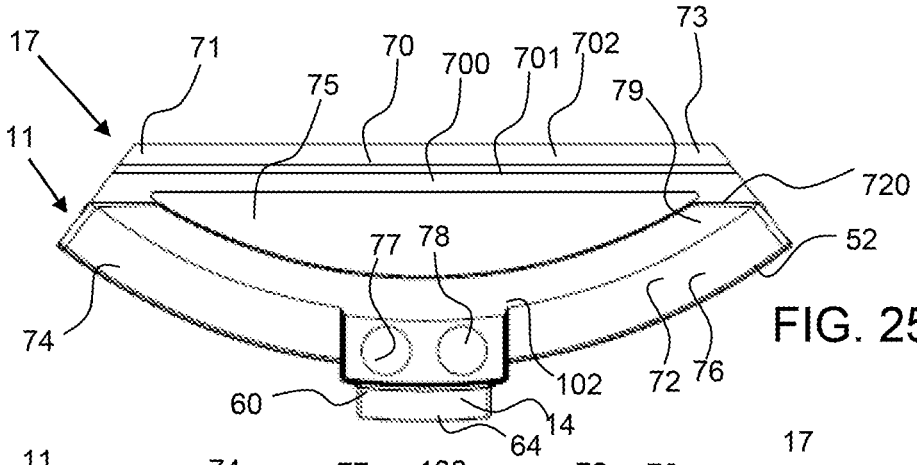
FIG. 25 shows a top view of an exemplary bucket implement coupler, an implement scraper.
Figure 26:
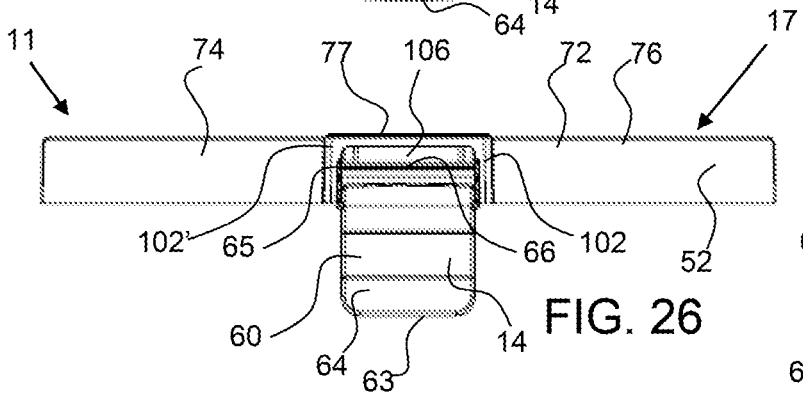
FIG. 26 shows a back view of an exemplary bucket implement coupler, an implement scraper.
Figure 27:
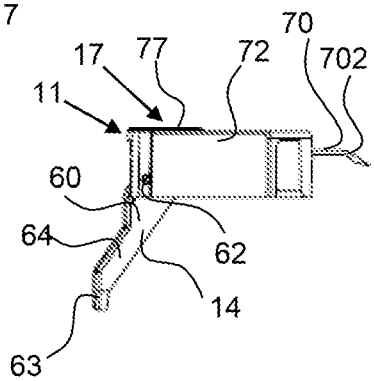
FIG. 27 shows a side view of an exemplary bucket implement coupler, an implement scraper.
Figure 28:
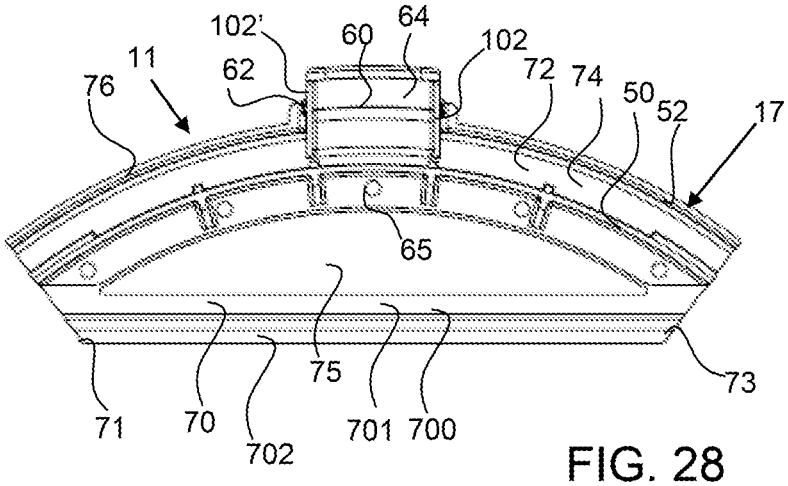
FIG. 28 shows a bottom view of an exemplary bucket implement coupler, an implement scraper.

Referring to FIGS. 23 to 29, an exemplary bucket implement coupler 11, an implement scraper 17, has a rim extension 72 that is coupled to a top rim of a bucket. A left rim extension 74 extends circumferentially to the left from the bucket coupler 14 and magnetic coupler 77, and a right rim extension 76 extends to the right from the bucket coupler and magnetic coupler. A magnetic coupler 77 is configured on the top of the bucket implement coupler, and has a pair of magnets 78 for retaining a scraper implement, or any other magnetic implement. The bucket coupler 14 has a latch 60 configured to detachably attach the bucket implement coupler to the bucket. The latch handle 64 is configured to rotate about a latch pivot 62 to bring the latch lock end 65, and the latch lock 66 into engagement with the bucket, such as against the top rim of the bucket. The handle end 63 is rotated down to engage the latch lock with the bucket rim. The latch handle pivots within a latch slot 106 formed by the two opposing latch flanges extending down from the exterior flange. As shown in FIG. 24, the latch pivot 62, employs pivot extensions extending into latch pivot apertures 69 in the latch flanges 102.

Figure 29:
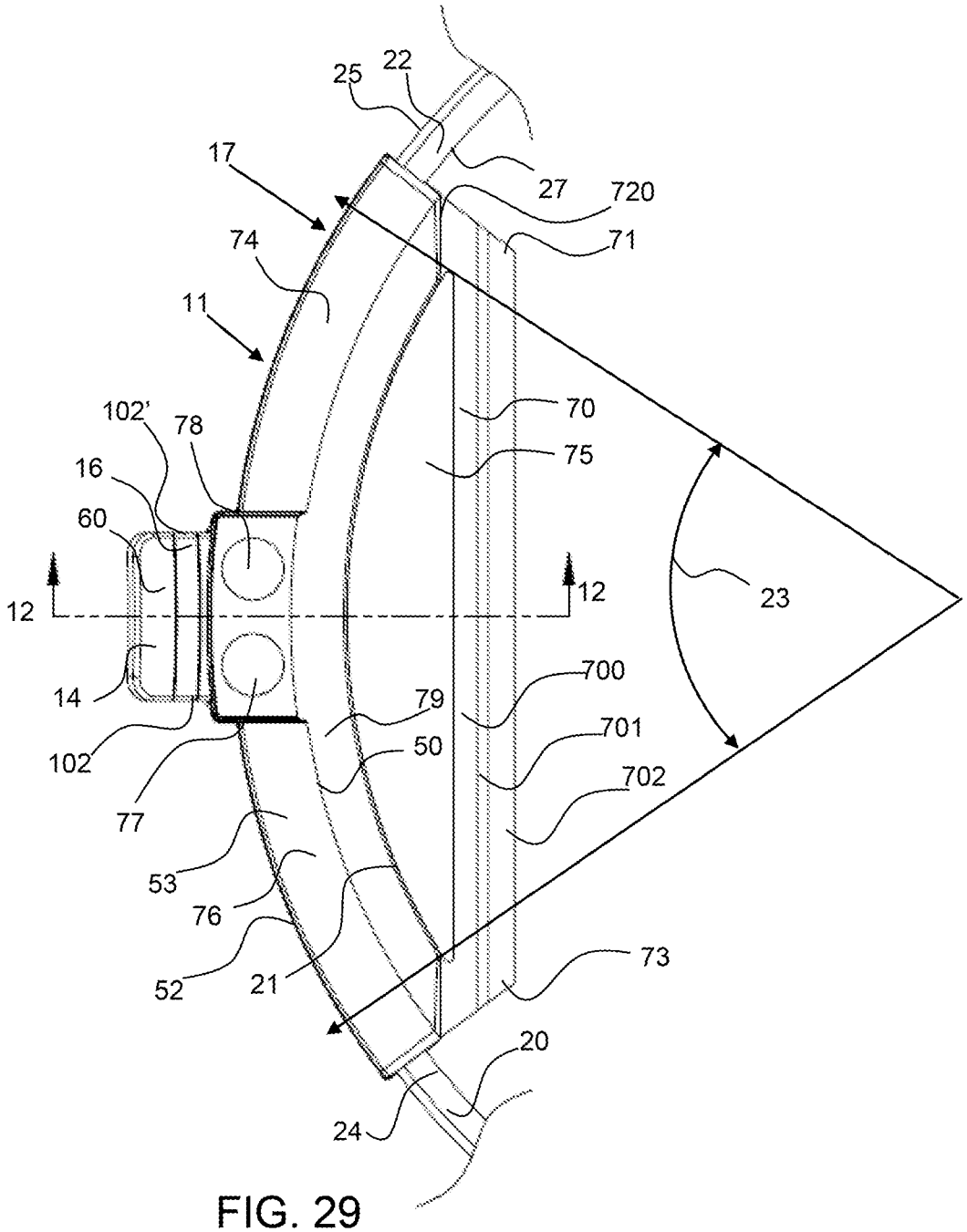
FIG. 29 shows a top view of an exemplary bucket implement coupler, an implement scraper, and the debris aperture formed between the scraper bar and the inner surface of the wall of the bucket or the interior flange of the rim extension.

Also shown best in FIG. 24, the scraper bar assembly 700 is a monolithic component having the scraper bar 70 formed with the rim coupler 720. The scraper bar 70 is configured to extend across a top opening of a bucket and has a left end 71 and a right end 73 that are coupled with the rim coupler. The rim coupler extends a radius of curvature and is configured to slide into a bar slot within the rim extension 72. As shown in FIGS. 23, 25, 28 and 29, the scraper bar forms a debris aperture 75 between the scraper bar and the inside surface of the top extension 79 and the interior surface 27 of the wall 25 of the bucket. As shown in FIG. 29, the scraper blade extends an extension angle 23 around the outer circumference of the top rim 24 of the bucket. The extension angle shown is about 60 degrees.

Figure 30:
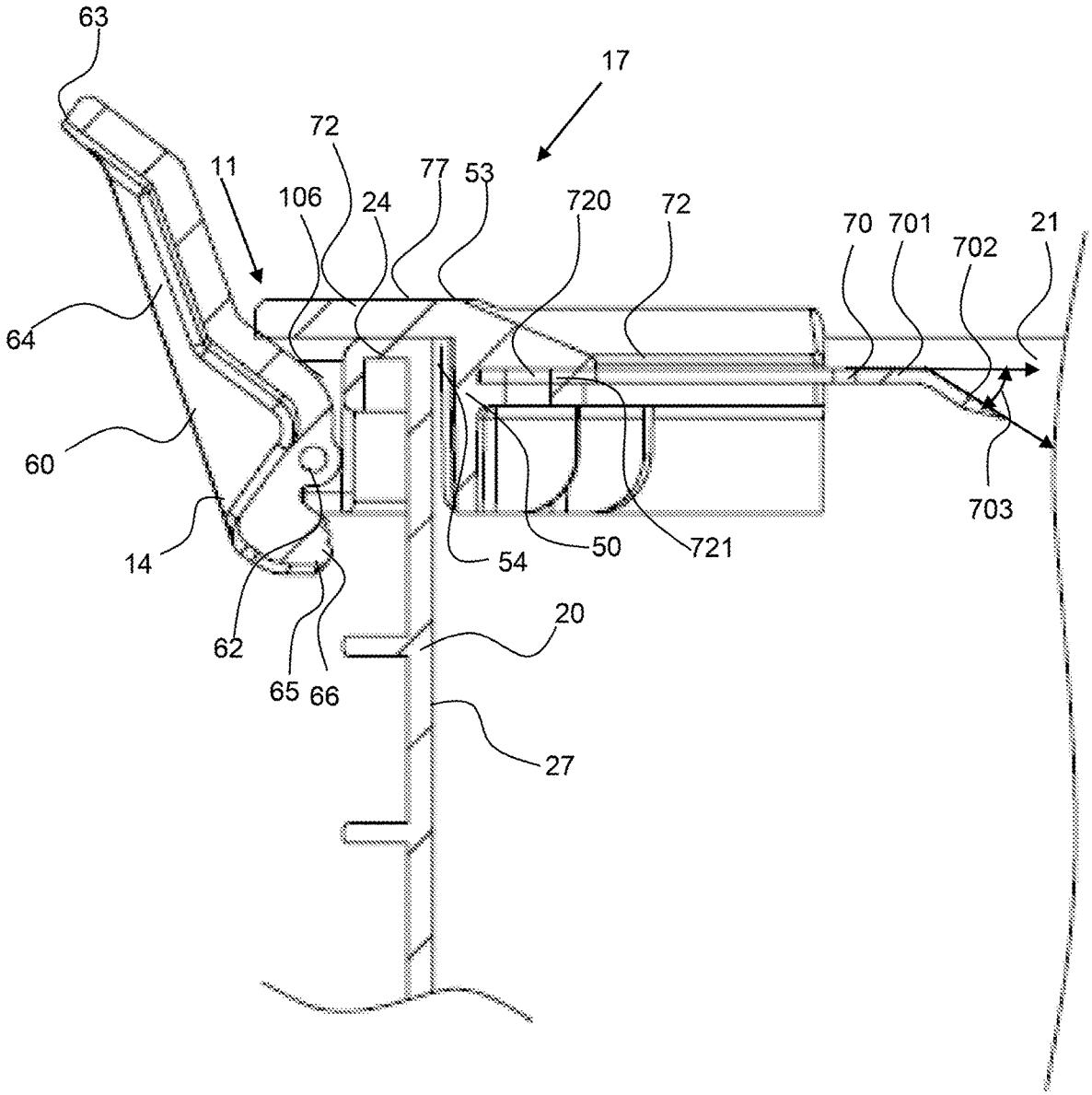
FIG. 30 shows a side cross sectional view of an exemplary bucket implement coupler, an implement scraper, configured on the top rim of a bucket with the latch in an open configuration.
Figure 31:
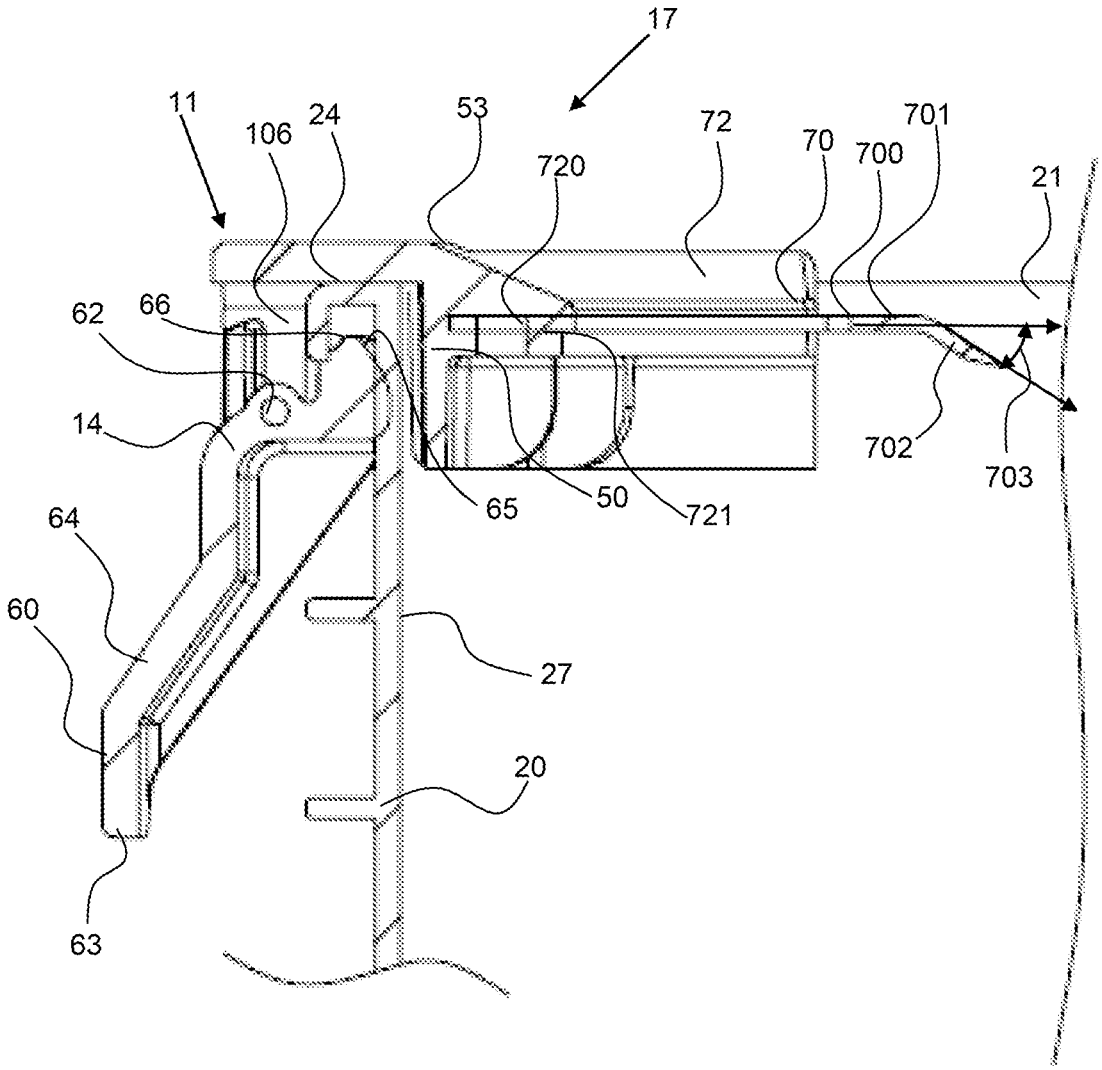
FIG. 31 shows a side cross sectional view of an exemplary bucket implement coupler, an implement scraper, configured on the top rim of a bucket with the latch in a down and secured or latched configuration.

Referring now to FIGS. 30 and 31, an exemplary bucket implement coupler 11, an implement scraper 17, is configured on the top rim 24 of a bucket 20 with the rim slot 54 configured over the top rim of the bucket. The scraper bar assembly 700 is detachably attached to the rim extension 72 with the rim coupler 720 configured in the bar slot. In FIG. 30, the latch 60 is in an open configuration with the handle end 63 of the latch handle 64 rotated up and the latch lock end 65 and latch lock 66 rotated down away from the bucket. In FIG. 31, the latch handle 64 of the latch 60 is rotated about the latch pivot 62 to bring the latch lock end 65 and latch lock 66 into engagement with the top rim 24 of the bucket 20.

Figure 32:
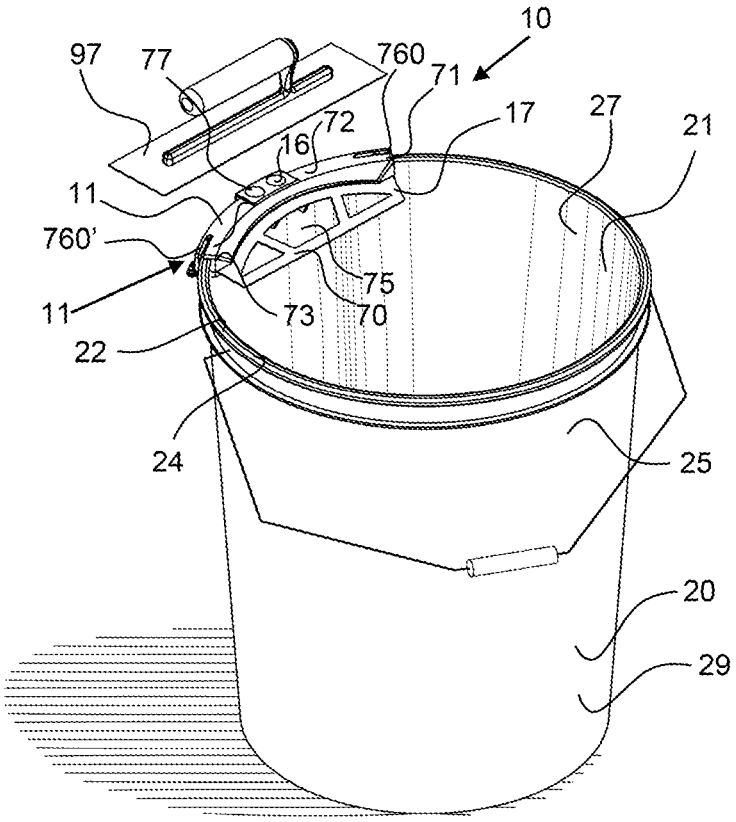
FIG. 32 shows a perspective view of an exemplary bucket implement coupler detachably attached to the top rim of the bucket and configured to retain a scrapper implement and having a scrapper bar extending over the interior of the bucket.
Figure 33:
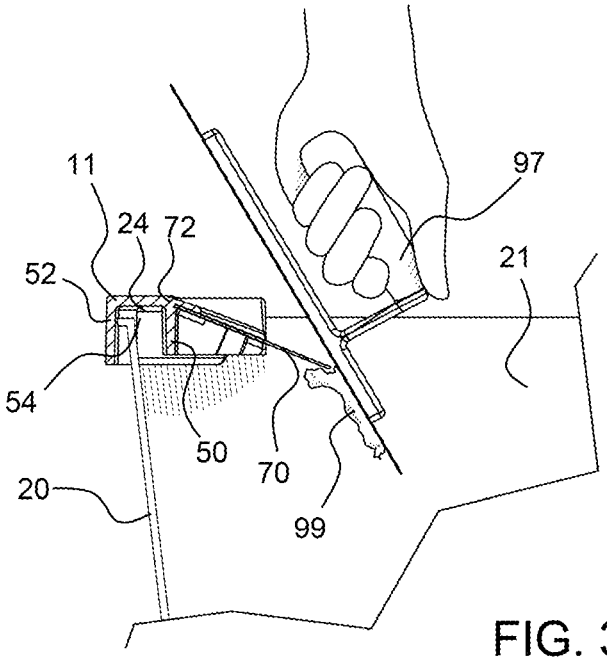
FIG. 33 shows a cross sectional view of the bucket implement coupler shown in FIG. 32 with the scrapper implement being pulled over the scrapper bar to remove debris from the scrapper implement.
Figure 39:
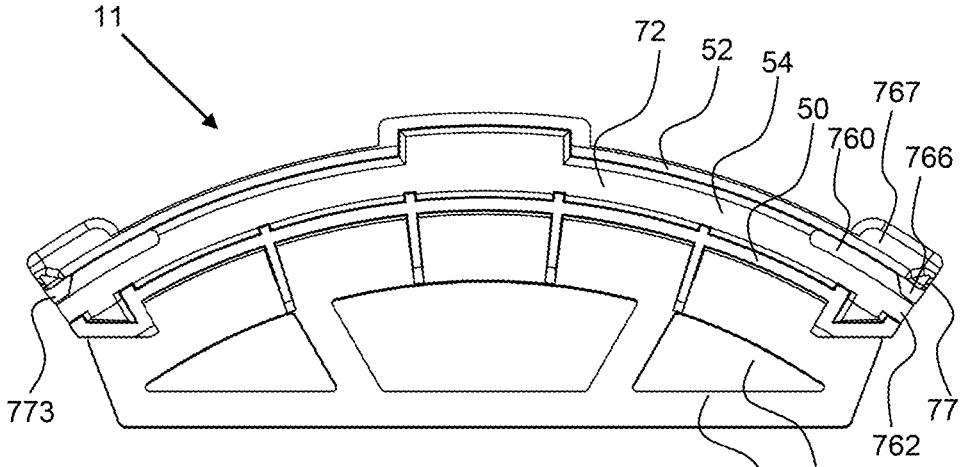
FIG. 39 shows a bottom view of the bucket implement coupler shown in FIG. 32.
Figure 40:
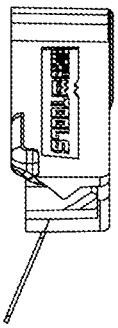
FIG. 40 shows a side view of the bucket implement coupler shown in FIG. 39.
Figure 41:
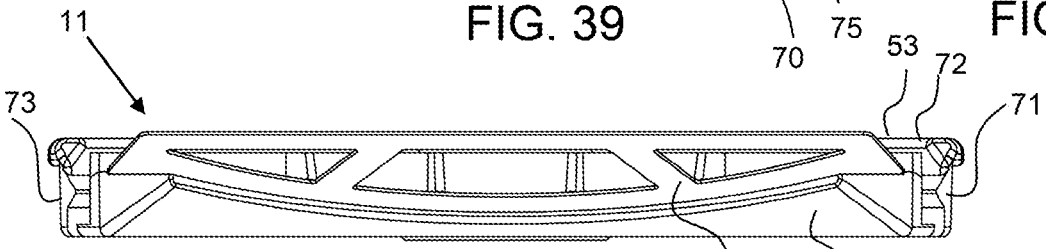
FIG. 41 shows an inside view of the bucket implement coupler shown in FIG. 39.

Referring now to FIGS. 32 to 44, an exemplary bucket implement coupler 11 is detachably attached to the top rim 24 of a bucket 20 and configured to retain an implement, via an implement coupling 16, such as a magnetic coupler 77 for detachable attachment of an implement scrapper 17, or the slot 16' for insertion of the scrapper bar 70 extending over the interior of the bucket. Other implement couplers may be configured on or attached to the bucket implement coupler 11 for attachment of other implements, such as a hose, mixer and the like. The bucket implement coupler 11 also has magnetic coupler 77, such as a magnet 78 that may also be used to retain an implement, specifically a metal implement to the bucket implement coupler. As shown in FIG. 32 a scrapper implement 97 may be detachably attached to the bucket implement coupler 11 by the magnetic coupler 77. As shown in FIG. 33, the scrapper implement 97 is being pulled over the scrapper bar 70 to remove debris 99 from the scrapper implement. The debris may fall through the debris aperture 75 of the implement scrapper 17 and into the top opening 21 of the bucket 20.

The bucket implement coupler 11 is detachably attachable to the bucket 20 and has an attachment flange 766 that extends from the exterior flange 52 of the rim extension 72 inward into the rim slot 54, or towards the interior flange 50. End slots 760, 760' extend along the top 24 of the rim extension 72 from the left end 771 and right end 773, respectively. Each of said end slots has an end slot opening 762 configured between the interior flange 50 and exterior flange 52 and extends to an extended end 764. The length of the rim slot may be effectively long to enable the exterior and/or the interior flange to deflect to enable the attachment flange to slide down over the rim flange 26 of the bucket. The rim flange 26 of the bucket extends down from the top rim 24 of the bucket and forms an outer perimeter of the top rim of the bucket. As best shown in FIGS. 34 to 38, a release flange 767 extends outward from the exterior flange 52 of the rim extension 72 to provide an aid in lifting the exterior flange out and up to release the attachment flange 766 from the rim flange 26 of the bucket. The attachment flange may extend a proportion of the width of the rim slot, such as about 20% or more, about 25% or more, about 30% or more, about 40% or more, about 50% or more, about 60% or less and any range between and including the percentages provided.

As shown in FIGS. 36 to 38, the bucket implement coupler 11 is detachably attachable to the top rim 24 of a bucket 20 with the end slot aiding in the exterior flange 52 deflecting to allow the attachment flange 766 to slide down over the rim flange 26 and then pop under the rim flange to secure the bucket implement coupler 11 to the bucket 20. The release flange can then be pulled out and/or up to deflect the exterior flange 52 to detach the bucket implement coupler 11 from the bucket 20. The release flange may be configured proximal to or on the left end 771 and right end 773 of the rim extension 72.

Figure 42:
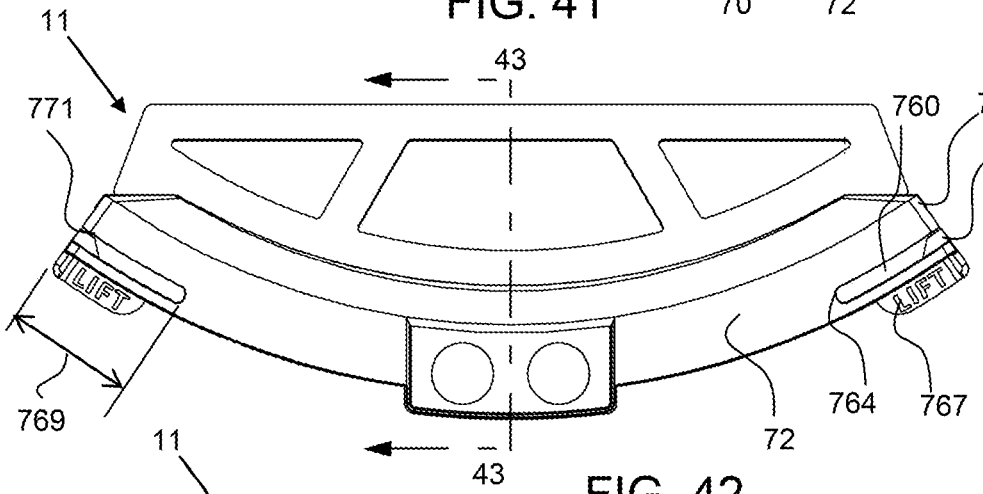
FIG. 42 shows a top view of the bucket implement coupler shown in FIG. 39.
Figure 43:
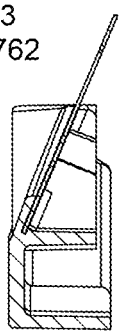
FIG. 43 shows a cross sectional view of the bucket implement coupler shown in FIG. 42 along line 43-43.
Figure 44:
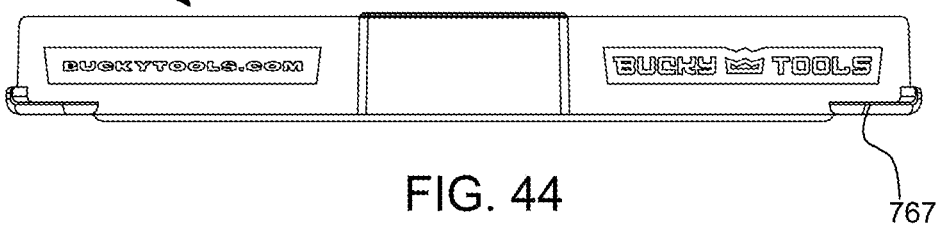
FIG. 44 shows an outside view of the bucket implement coupler shown in FIG. 39.

As shown in FIG. 42, the end slot 760 has a length 769 from the end slot opening 762 to the extended end 764 that is a portion of the length of the rim extension 72, such as about 30% or less, 20% or less, about 15% or less, about 10% or less, about 7.5% or less, about 5% or less or any range between and including the values provided. The length of the end slot should be long enough to allow deflection of the interior and/or exterior flanges of the rim slot, but should not be too long to compromise the firm and secure engagement of the attachment flange with the rim flange of the bucket.

The left side of the rim extension is the left side when the rim extension is attached to the top rim of the bucket and viewed from an exterior or outside of the bucket. Likewise, the right side of the rim extension is the right side when the rim extension if attached to the top rim of the bucket and viewed from an exterior or outside of the bucket. The top of the rim extension is the top when the bucket implement coupler is attached to a bucket and the bucket is resting on a horizontal surface or is right-side up.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A bucket implement coupler comprising:

a) a rim extension having a radius of curvature and configured to extend circumferentially along a top rim of a bucket, said rim extension comprising:

i) an interior flange configured for extending down over an interior surface of said bucket;

ii) an exterior flange configured to extend down over an exterior surface of said bucket;

iii) a rim extension top;

iv) a rim slot formed by said interior flange, exterior flange and rim extension top;

v) an end slot extending in from a left end of the rim extension and an end slot extending in from the right end of the rim extension;

vi) two attachment flanges wherein a first attachment flange of said two attachment flanges is configured proximal to said left end and wherein a second attachment flange of said two attachment flanges is configured proximal to said right end of the rim extension, and wherein each of said two attachment flanges extends from an interior wall of the exterior flange into the rim slot and toward the interior flange;

vii) two release flanges wherein a first release flange of said two release flanges is configured proximal to ach of said left end and wherein a second release flange of said two release flanges is configured proximal to said right end of the rim extension, and wherein each of said two release flanges extends from an exterior wall of the exterior flange and out away from the rim slot;

b) an implement coupling configured to detachably attach an implement to the rim extension;

wherein with the rim slot configured over said top rim of said bucket, the rim extension is configured to slide down over the top rim to secure the attachment flange against a rim flange of the bucket to detachably attach the bucket implement coupler to said top rim of said bucket.

2. The bucket implement coupler of claim 1, wherein each of the rim slots extend circumferentially in a radius of curvature configured to fit on a five-gallon bucket, wherein the radius of curvature is between 13 cm and 17 cm.

3. The bucket implement coupler of claim 1, wherein each of the rim slots extend along a radius of curvature that is within 20% of a radius of curvature of the top rim of the bucket.

4. The bucket implement coupler of claim 3, wherein each of the rim slots extend along a radius of curvature that is within 30% of a radius of curvature rim slot.

5. The bucket implement coupler of claim 4, wherein each of the rim slots has a length of no more than 100 mm.

6. The bucket implement coupler of claim 5, wherein each of the rim slots has a length of at least 1 mm.

7. The bucket implement coupler of claim 5, wherein each of the rim slots has a length of at least 5 mm.

8. The bucket implement coupler of claim 1, wherein each of the rim slots has a length of no more than 100 mm.

9. The bucket implement coupler of claim 1, wherein each of the rim slots has a length of at least 1 mm.

10. The bucket implement coupler of claim 1, wherein each of the rim slots has a length of at least 5 mm.

11. The bucket implement coupler of claim 10, wherein each of the rim slots has a length of at least 10 mm.

12. The bucket implement coupler of claim 1, wherein each of the two attachment flanges extends across at least 5% of the rim slot.

13. The bucket implement coupler of claim 1, further comprising a scraper bar coupled to the rim extension and forming a debris aperture configured between the scraper bar and the rim extension; and wherein the scraper bar extends across a portion of a top opening of said bucket.

14. The bucket implement coupler of claim 13, wherein the scraper bar is detachably attachable to the bucket implement coupler.

15. The bucket implement coupler of claim 13, wherein the scraper bar comprises a planar bar extension and a beveled portion extending a beveled angle from the planar bar extension.

16. The bucket implement coupler of claim 13, wherein the scraper bar is coupled with a scraper blade assembly having a rim coupler.

17. The bucket implement coupler of claim 16, wherein the scraper bar assembly is detachably attachable to the rim extension, wherein the rim extension comprises a bar slot for receiving the rim coupler.

18. The bucket implement coupler of claim 1, further comprising a magnetic coupler comprising a magnet to retain a magnetic implement to the bucket implement coupler.

19. The bucket implement coupler of claim 18, wherein the magnetic coupler is detachably attachable to the bucket coupler.

20. The bucket implement coupler of claim 1, wherein a rim coupler comprises a debris diverter that extends inward from the interior flange and downward into said bucket when the bucket implement coupler is coupled to said top rim of said bucket.

* * * * *